US009671742B2

(12) United States Patent
Gu et al.

(10) Patent No.: US 9,671,742 B2
(45) Date of Patent: Jun. 6, 2017

(54) PROCESS CARTRIDGE HAVING A CONTROL MECHANISM FOR A DRIVING MECHANISM

(71) Applicant: ZHUHAI SEINE TECHNOLOGY CO., LTD., Zhuhai (CN)

(72) Inventors: Weidong Gu, Zhuhai (CN); Geming Ding, Zhuhai (CN); Yonghong Li, Zhuhai (CN); Zhiyong Li, Zhuhai (CN); Jianxin Cao, Zhuhai (CN); Xiong Li, Zhuhai (CN); Xiaobing Liu, Zhuhai (CN)

(73) Assignee: ZHUHAI SEINE TECHNOLOGY CO., LTD., Zhuhai (CN)

( * ) Notice: Subject to any disclaimer, the term of this patent is extended or adjusted under 35 U.S.C. 154(b) by 0 days.

(21) Appl. No.: 15/063,806

(22) Filed: Mar. 8, 2016

(65) Prior Publication Data

US 2016/0187844 A1 Jun. 30, 2016

Related U.S. Application Data

(63) Continuation of application No. 14/642,877, filed on Mar. 10, 2015, now Pat. No. 9,488,958, which is a (Continued)

(30) Foreign Application Priority Data

Jan. 28, 2010 (CN) ..... 2010 1 0104692
Mar. 22, 2010 (CN) ..... 2010 1 0131386

(51) Int. Cl.
*G03G 15/00* (2006.01)
*G03G 21/18* (2006.01)

(52) U.S. Cl.
CPC ..... *G03G 15/757* (2013.01); *G03G 21/186* (2013.01); *G03G 21/1857* (2013.01)

(58) Field of Classification Search
CPC . G03G 21/1857; G03G 21/186; G03G 15/757
(Continued)

(56) References Cited

U.S. PATENT DOCUMENTS

2006/0127129 A1 6/2006 Jun et al.
2008/0089713 A1 4/2008 Ishida et al.
(Continued)

FOREIGN PATENT DOCUMENTS

CN 1430114 A 7/2003
CN 2615707 Y 5/2004
(Continued)

OTHER PUBLICATIONS

Annex to EPO Communication dated Jun. 11, 2015 issued in connection with European Application No. 10844463.9.
(Continued)

*Primary Examiner* — Quana M Grainger
(74) *Attorney, Agent, or Firm* — Troutman Sanders

(57) ABSTRACT

The invention relates to a process cartridge, which comprises a process cartridge housing, a photosensitive member, a driving force receiving opening, a retractable mechanism and a control mechanism, wherein the photosensitive member is arranged inside the process cartridge housing; the driving force receiving opening is connected with the photosensitive member and provides a driving force for the photosensitive member; the retractable mechanism allows the driving force receiving opening to extend or retract in the axial direction of the photosensitive member; and the control mechanism controls the extension and retraction of the retractable mechanism.

20 Claims, 17 Drawing Sheets

Related U.S. Application Data continuation-in-part of application No. 13/548,981, filed on Jul. 13, 2012, now Pat. No. 9,176,467, which is a continuation-in-part of application No. PCT/CN2010/079377, filed on Dec. 2, 2010.

(58) Field of Classification Search
USPC ..... 399/111
See application file for complete search history.

(56) References Cited

U.S. PATENT DOCUMENTS

| | | | |
|---|---|---|---|
| 2009/0131212 | A1 | 5/2009 | Marumoto |
| 2011/0255900 | A1 | 10/2011 | Zhou et al. |
| 2012/0275824 | A1 | 11/2012 | Gu et al. |

FOREIGN PATENT DOCUMENTS

| | | | |
|---|---|---|---|
| CN | 101916055 | | 12/2010 |
| EP | 0833228 | | 4/1998 |
| EP | 1170641 | A2 | 9/2002 |
| JP | 11109752 | | 4/1999 |
| JP | 2008233867 | | 10/2008 |
| JP | 2011133682 | | 7/2011 |
| WO | 2011091686 | A1 | 4/2011 |

OTHER PUBLICATIONS

EPO Communication dated Jul. 30, 2015 issued in connection with European Application No. 10844463.9.
EPO Observations by third parties dated Jul. 24, 2015 issued in connection with European Application No. 10844463.9.
Extended European Search Report dated Sep. 30, 2014 issued in connection with European Application No. 10844463.9.
Final Office Action dated Jul. 30, 2015, issued in connection with U.S. Appl. No. 13/548,981.
Final Office Action dated Nov. 21, 2014, issued in connection with U.S. Appl. No. 13/548,981.
Final Office Action, Japanese Patent Application No. 2012550302, also published as WO 2011091686A1, dated Jul. 17, 2015.
International Search Report dated Mar. 10, 2011, issued in connection with International Application No. PCT/CN/2010/079377.
Office Action dated Apr. 6, 2015, issued in connection with U.S. Appl. No. 13/548,981.
Office Action dated Jan. 30, 2013 issued in connection with Chinese Application No. 201010585490.8.
Office Action dated Jul. 11, 2012 issued in connection with Chinese Application No. 201010585490.8.
Office Action dated May 8, 2014, issued in connection with U.S. Appl. No. 13/548,981.
Office Action, Japanese Patent Application No. 2012550302, also published as WO 2011091686A1, dated Sep. 1, 2014.
Russian Search Report dated Aug. 20, 2014, issued in connection with RU Application No. 2012131978/28.

PROCESS CARTRIDGE HAVING A CONTROL MECHANISM FOR A DRIVING MECHANISM

CROSS-REFERENCE TO RELATED APPLICATIONS

This is a continuation of U.S. application Ser. No. 14/642,877, filed on Mar. 10, 2015, which is a continuation-in-part application of U.S. application Ser. No. 13/548,981, filed on Jul. 13, 2012, which is a continuation-in-part application of International Application PCT/CN2010/079377, with an international filing date of Dec. 2, 2010, which claims priority to Chinese Patent Application No. 201010104692.6, Jan. 28, 2010, and Chinese Patent Application No. 201010131386.1, filed Mar. 22, 2010. The contents of the foregoing applications are incorporated by reference in their entireties.

FIELD OF THE INVENTION

The invention relates to an image forming device based on electrostatic printing technology, in particular to a process cartridge applied to the same.

BACKGROUND OF THE INVENTION

The invention relates to a process cartridge which is detachably arranged on an image forming device based on electrostatic printing technology, wherein the image forming device can be any one of a laser image forming device, an LED image forming device, a copier or a facsimile apparatus.

The working process of the image forming device based on the electrostatic printing technology is as follows: firstly, predetermined charges are uniformly charged on the surface of a photosensitive member by a charging component; secondly, an electrostatic latent image is formed on the surface of the photosensitive member, with the predetermined charges, is subjected to exposure treatment; thirdly, a developer is conveyed to the photosensitive member by developing components, so that the electrostatic latent image on the surface of the photosensitive member can be developed; fourthly, the developer on the electrostatic latent image is transferred to an image recording medium such as paper after transfering; and finally, the developer, which is not completely transferred, on the surface of the photosensitive member, is cleaned by a cleaning component, so that the photosensitive member is allowed to go into the next charging, and the next cycle.

A process cartridge is used in the image forming device. As a cartridge unit, the process cartridge is integrated with one or more than one of the following components: a photosensitive member such as an organic photosensitive drum and a series of components acting on the photosensitive member, such as the charging component, the cleaning component and the developing components.

A process cartridge in the prior art comprises two main frames, wherein a charging roller, a wiper blade and a photosensitive member are arranged on a first main frame; a developer, a magnetic roller and an adjusting blade used for adjusting the thickness of the developer on the magnetic roller are reserved on a second main frame; the charging roller is taken as a charging component; the wiper blade is taken as a cleaning component; the magnetic roller, the adjusting blade, etc. are taken as developing components; and the first main frame and the second main frame which are provided with the above components are assembled to form the process cartridge as a whole. The process cartridge is assembled or disassembled on an image forming device by a terminal user, wherein a professional maintainer is not required, thus the maintenance is convenient for terminal users.

In general, a driving force receiving opening is arranged on the photosensitive member and engaged with a driving mechanism in the image forming device to drive the photosensitive member to perform rotational movement. However, as the photosensitive member is required to be detachably arranged on the image forming device along with the process cartridge, the driving force receiving opening and the driving mechanism are required to be disengaged when the process cartridge is disassembled from the image forming device, so that the process cartridge can be successfully disassembled from the image forming device; and the driving force receiving opening and the driving mechanism are required to be engaged when the process cartridge is assembled into the image forming device for printing, so that the photosensitive member can be rotated successfully.

The Chinese patent application CN200920129260.3 discloses a process cartridge with a flexible pressure device. The flexible pressure device is arranged on a photosensitive drum and allows a driving force receiver to stably receive a driving force, so that the driving force receiver has free gap in the rotational axial direction of the photosensitive drum. Therefore, not only the driving force receiver has certain free gap in the rotational axial direction of the photosensitive drum and leans against a driving end of an image forming device to realize the assembly of a toner cartridge in the axial direction of the photosensitive drum but also the coaxial transmission between the driving force receiver and the photosensitive drum is more reliable and the structure is simpler. Moreover, as the driving force receiver is detachably arranged at one end of the photosensitive drum, the photosensitive drum is convenient in maintenance. As different driving force receivers are used for different image forming devices but the main body, namely the photosensitive drum, is the same, users only need to replace the driving force receiver but not need to replace the photosensitive drum, thus the manufacturing cost and the use cost are reduced. However, due to the flexible pressure device, the driving force receiver, namely the driving force receiving opening, is always in the pressurized state when beginning to get engaged and disengaged with a driving mechanism of the image forming device, thus the driving force receiver and the driving member for the image forming device cannot be kept in a straight line when beginning to get engaged and disengaged as the inner space of the image forming device is limited, consequently the driving force receiver and the driving member of the image forming device are inevitably subjected to the friction damage when meeting a bevel when beginning to get engaged and disengaged and then the engagement between the driving force receiver and the driving member of the image forming device is affected.

SUMMARY OF THE INVENTION

The invention provides a process cartridge to solve the technical problem that a driving force receiving opening for the traditional process cartridge and a driving mechanism for an image forming device can be subjected to the friction damage when meeting a bevel when beginning to get engaged and disengaged and then the engagement between the driving force receiving opening for the traditional process cartridge and the driving mechanism for the image forming device is affected.

In order to solve the technical problem, the invention adopts the technical proposal that:

The invention relates to a process cartridge, which comprises a process cartridge housing, a photosensitive member, a driving force receiving opening, a retractable mechanism and a control mechanism, wherein the photosensitive member is arranged inside the process cartridge housing; the driving force receiving opening is connected with the photosensitive member and provides a driving force for the photosensitive member; the retractable mechanism allows the driving force receiving opening to extend or retract in the axial direction of the photosensitive member; and the control mechanism controls the extension and retraction of the retractable mechanism;

The control mechanism comprises a first elastic component and a press rod which is arranged at one side of the process cartridge housing, at which the driving force receiving opening is arranged; the press rod is connected with the retractable mechanism; and one end of the first elastic component is connected with the press rod while the other end of the first elastic component is connected with the process cartridge housing.

An opening is provided at one end of the press rod; an urging surface and a retracted surface are arranged at the end of the press rod, at which the opening is provided; the urging surface and the retracted surface have height difference in the axial direction of the photosensitive member; and a support base is arranged on the driving force receiving opening and can be supported by the urging surface or the retracted surface.

The control mechanism comprises a solenoid valve, a power source for supplying electrical energy to the solenoid valve, and a circuit for converting the power source into the electrical energy required by the solenoid valve; the solenoid valve is fixed on the process cartridge housing; the retractable mechanism comprises an A core and a shaft which interact with the solenoid valve; the A core and the shaft are integrated into a whole; the driving force receiving opening is arranged at one end of the shaft; and one end of the A core is connected with the photosensitive member and transmits driving force for the photosensitive member.

The solenoid valve is a single-coil solenoid valve.

The control mechanism comprises a guy of which one end is connected with the retractable mechanism and the other end receives a tensile force, and the guy is arranged on the process cartridge housing.

The control mechanism comprises a double-coil solenoid valve, a power source for supplying electrical energy to the solenoid valve, and a circuit for converting the power source into the electrical energy required by the solenoid valve; a first coil, a second coil and a magnet are arranged on the solenoid valve which is fixed on the process cartridge housing; the retractable mechanism also comprises an A core and a shaft which interact with the solenoid valve; the A core and the shaft are integrated into a whole; the driving force receiving opening is arranged at one end of the shaft; and one end of the A core is connected with the photosensitive member and transmits driving force for the photosensitive member.

The photosensitive member and the process cartridge housing do not slide relative to each other; and one end of the retractable mechanism is connected with the photosensitive member while the other end of the retractable mechanism is connected with the driving force receiving opening.

The photosensitive member is fixedly connected with the driving force receiving opening; and one end of the retractable mechanism is connected with the process cartridge housing while the other end of the retractable mechanism is connected with the photosensitive member or the driving force receiving opening.

The retractable mechanism comprises guide grooves which are arranged on the photosensitive member and guide posts which are arranged on the driving force receiving opening; and the guide posts can slide along the guide grooves.

The retractable mechanism also comprises a transmission part; the photosensitive member is also provided with stressed columns; and the driving force transmission between the driving force receiving opening and the photosensitive member is performed through the engagement of the transmission part and the stressed columns.

A plurality of the stress columns are arranged; and said transmission part is arranged between steel plates between said stressed columns.

The photosensitive member or the driving force receiving opening is supported on the process cartridge housing and can slide along the process cartridge housing.

The process cartridge housing is also provided with a shaft pin and a support; both ends of the photosensitive member are respectively supported by the shaft pin and the support on the process cartridge housing; and the photosensitive member can slide relative to the shaft pin and the support.

The retractable mechanism comprises a second elastic component which is arranged between the driving force receiving opening and the photosensitive member.

The retractable mechanism comprises a second elastic component which is arranged between the driving force receiving opening and the process cartridge housing.

The second elastic component is a tension spring.

By adoption of the technical proposal, due to the addition of the control mechanism for controlling the extension and retraction of the retractable mechanism, the extension and retraction of the driving force receiving opening can be controlled just by controlling the extension and retraction of the retractable mechanism through the control mechanism when the driving force receiving opening and a driving mechanism for an image forming device begin to get engaged and disengaged, thus the driving force receiving opening and the driving mechanism for the image forming device can be kept in a straight line when beginning to get engaged and disengaged, consequently the engagement between the driving force receiving opening and the driving mechanism for the image forming device cannot be affected by the friction damage when meeting a bevel. Therefore, the technical problem, that the engagement between the driving force receiving opening for the traditional process cartridge and the driving mechanism for the image forming device is affected by the friction damage when meeting the bevel when beginning to get engaged and disengaged, is solved. Moreover, the control mechanism has two modes, namely mechanical control and solenoid-valve control, so that users not only can select the safe and reliable mechanical control mode as required but also can select the solenoid-valve control mode according to the requirement of automatic control. Meanwhile, the invention also provides a plurality of reliable retractable mechanisms, so that the reliability of the retractable mechanisms is greatly improved.

BRIEF DESCRIPTION OF THE DRAWINGS

FIGS. 6 and 7 are schematic diagrams illustrating the interaction between the driving force receiving opening and a press rod for the process cartridge, wherein FIG. 6 illustrates the retracted state of the driving force receiving opening and FIG. 7 illustrates the extended state of the driving force receiving opening;

DETAILED DESCRIPTION OF THE PREFERRED EMBODIMENTS

First Embodiment

Figure 1:
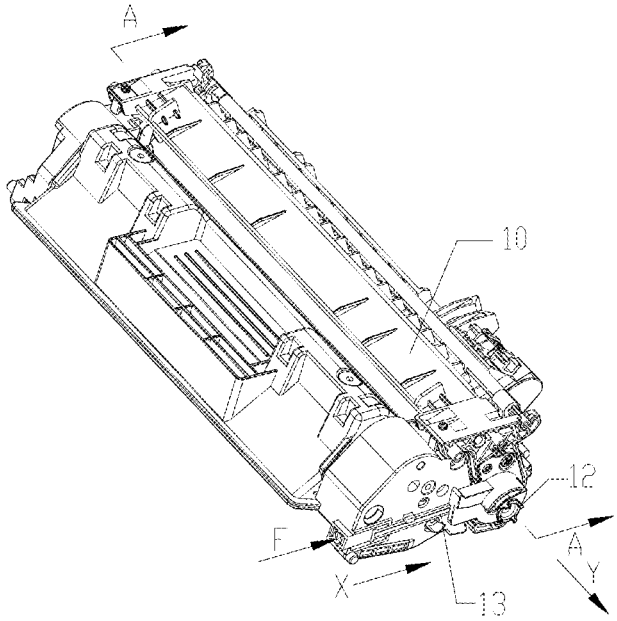
FIG. 1 is a stereogram of a process cartridge of the first embodiment of the invention.
Figure 2:
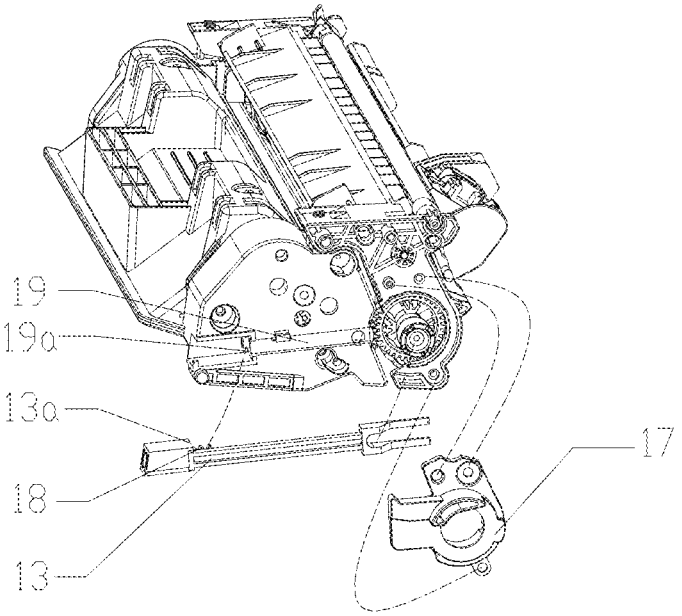
FIG. 2 is an exploded view of the process cartridge illustrated in FIG. 1.

FIG. 1 is a stereogram of a process cartridge of a preferred embodiment of the invention, and FIG. 2 is an exploded view of the process cartridge illustrated in FIG. 1. As illustrated in FIG. 2, a press rod 13 and a first spring 18 are arranged at one side of a process cartridge housing 10, where a driving force receiving opening 12 is arranged; the press rod 13 and the first spring 18 are combined into a control mechanism; the press rod 13 is arranged inside a guide groove 19 on the process cartridge housing 10 and slides back and forth along the guide groove 19 in the X direction; and the first spring 18 leans against a space between an urging surface 13*a* of the press rod 13 and a leaning surface 19*a* of the guide groove 19 and provides an elastic restoring force for the press rod 13. When the process cartridge is positioned on an image forming device, the urging surface 13*a* of the press rod 13 tends to be far away from the leaning surface 19*a* when the press rod 13 is under the action of the first spring 19; one end of the press rod 13 receives an applied force F from the outside to overcome the elastic force of the first spring 18, and the press rod 13 moves along the direction illustrated by an X arrowhead; and when the force F is canceled, the press rod 13 performs restoring movement along the direction opposite to the direction illustrated by the X arrowhead under the action of the elastic restoring force of the first spring 18.

Figure 6:
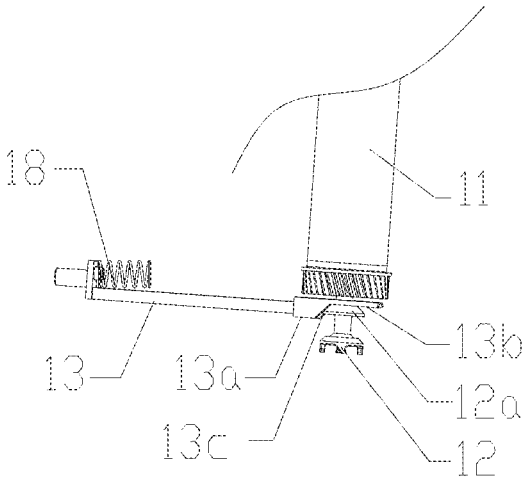
Figure 7:
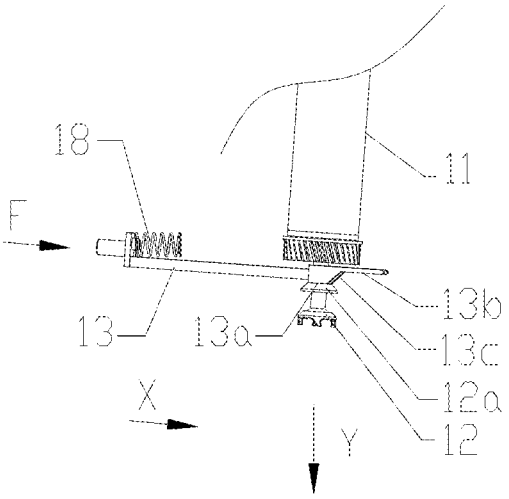

FIGS. 6 and 7 are schematic diagrams illustrating the interaction between the driving force receiving opening and the press rod, wherein FIG. 6 illustrates the state when the driving force receiving opening is retracted and FIG. 7 illustrates the state when the driving force receiving opening is extended. As illustrated in FIGS. 6 and 7, an urging surface 13*a* and a retracted surface 13*b* are arranged on the press rod 13 and are respectively arranged in a staggered form in the direction parallel to the length direction of the press rod 13, namely the X direction, and in the direction parallel to the axial direction of the driving force receiving opening, namely the Y direction; height difference is formed between the urging surface 13*a* and the retracted surface 13*b* in the Y direction; the urging surface 13*a* is in the upstream in the direction parallel to the X direction, and the retracted surface 13*b* is in the upstream in the direction parallel to the Y direction; and the urging surface 13*a* and the retracted surface 13*b* are subjected to transient connection through an inclined surface 13*c*. As illustrated in FIG. 6, when the press rod 13 is not pressed, the retracted surface 13*b* supports a support base 12*a* of the driving force receiving opening 12 in the axial direction of the driving force receiving opening 12, and the driving force receiving opening 12 is in the retracted state. As illustrated in FIG. 7, when the press rod 13 is pressed by the force F, the press rod 13 moves in the X direction; in the moving process, the support base 12*a* of the driving force receiving opening 12 is transferred from the state of being supported by the retracted surface 13*b* to the state of being supported by the urging surface 13*a* through the inclined surface 13*c*; and in the transient process, the driving force receiving opening 12 is extended in the Y direction and engaged with a driving mechanism 20 for the image forming device. When the force F is canceled, the press rod 13 is restored to the state illustrated in FIG. 6.

How to retract the driving force receiving opening 12 to guarantee that the driving force receiving opening 12 is disengaged with the driving mechanism on the image forming device and the process cartridge can be successfully disassembled from the image forming device, after the force F is canceled, is illustrated as follows.

Figure 8:
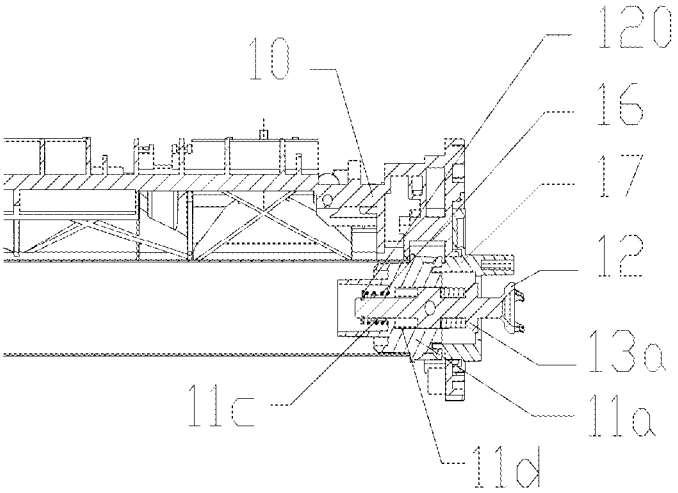
FIG. 8 is a section view of an A-A cross section of the process cartridge illustrated in FIG. 1 when the press rod is pressed and the driving force receiving opening is in the extended state.
Figure 9:
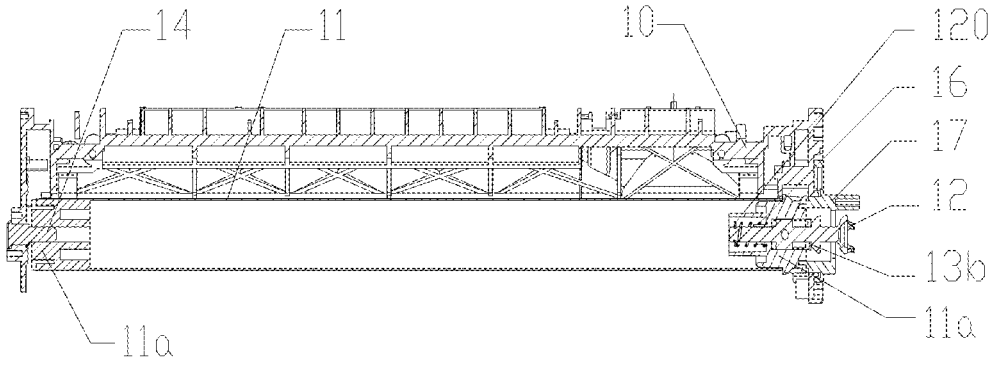
FIG. 9 is a section view of the A-A cross section of the process cartridge illustrated in FIG. 1 when the press rod is not pressed and the driving force receiving opening is in the retracted state.
Figure 10:
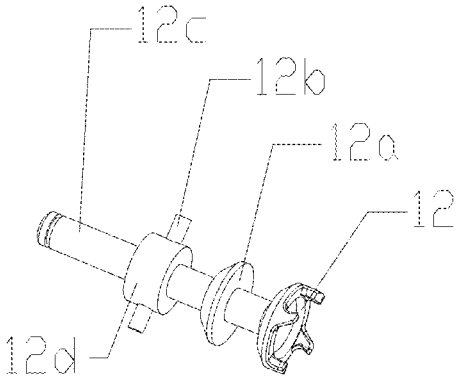
FIG. 10 is a stereogram of the driving force receiving opening for the process cartridge illustrated in FIG. 1.
Figure 11:
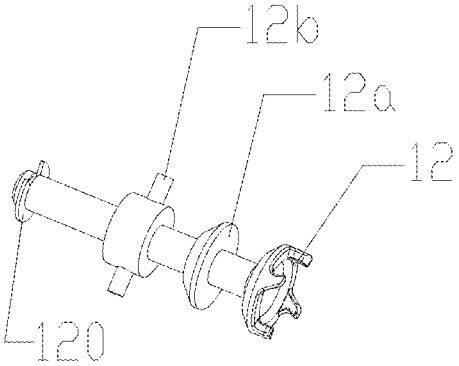
FIG. 11 is a stereogram of the driving force receiving opening for the process cartridge illustrated in FIG. 1 after a press fastener is arranged on the driving force receiving opening.

As showed in FIGS. 8, 9, 10 and 11. FIG. 8 is a section view of an A-A cross section of the process cartridge illustrated in FIG. 1 when the press rod 13 is pressed and the driving force receiving opening 12 is in the extended state; FIG. 9 is a section view of the A-A cross section of the process cartridge illustrated in FIG. 1 when the press rod 13 is not pressed and the driving force receiving opening 12 is in the retracted state; FIG. 10 is a stereogram of the driving force receiving opening 12 for the process cartridge; and FIG. 11 is a stereogram of the driving force receiving opening 12 for the process cartridge after a press fastener 120 is assembled on the driving force receiving opening 12. As illustrated in FIGS. 8 and 9, a photosensitive member 11 is rotationally supported on a main housing of the process cartridge, wherein a flange 11*a* at one end of the photosensitive member 11 is supported by a shaft pin 14 and a flange 11*a* at the other end of the photosensitive member 11 is supported by a support 17. Under the supporting action of the shaft pin 14 and the support 17, the photosensitive member 11 can only perform rotational movement around its axial line in the process cartridge, and cannot move along the axial direction of the photosensitive member 11.

As illustrated in FIGS. 8 and 9, a second spring 16 is arranged between the driving force receiving opening 12 and the flange 11*a* for the photosensitive member, namely the second spring 16 is arranged between the flange 11*a* and the press fastener 120 of the driving force receiving opening 12. The second spring 16 provides an elastic restoring force for the driving force receiving opening 12 so that the driving force receiving opening 12 tends to move along the direction opposite to the Y direction. After the process cartridge is assembled into the image forming device, the press rod 13 is pressed by the force F; the driving force receiving opening 12 is supported by the urging surface 13*a* and is in the extended state; and the second spring 16 is compressed between the end faces of the flange 11*a* and the press fastener 120. When the process cartridge is disassembled from the image forming device, the force F is canceled; the press rod 13 performs restoring movement along the direction opposite to the direction illustrated by the X arrowhead under the action of the first spring 18, and the urging surface 13*a* and the support base 12*a* are gradually disengaged; the driving force receiving opening 12 performs retracting movement along the direction opposite to the direction illustrated by the Y arrowhead under the action of the elastic force of the second spring 16 until the support base 12*a* contacts the retracted surface 13*b* and is supported by the retracted surface 13*b*; and herein, the driving force receiving opening 12 is in the retracted state and is disengaged with the driving mechanism 20 of the image forming device.

The connection relation between the driving force receiving opening 12 and the photosensitive member 11 and the driving force transmission process are illustrated as follows. As illustrated in FIGS. 10, 11, 12 and 13, a transmission part 12*b*, a first guide post 12*c* and a second guide post 12*d* are arranged on the driving force receiving opening 12; the transmission part 12*b* is arranged on the second guide post 12*d*; a stressed groove 11*b*, a first guide groove 11*c*, a second guide groove 11*d*, steel plates 11*e* and a plurality of stressed columns 11*f* are arranged on the flange 11*a* of the photosensitive member 11; the second guide groove 11*d* is arranged on the sidewalls of the stressed columns 11*f*; the transmission part 12*b* is arranged on the stressed groove 11*b* and can be engaged with the stressed columns 11*f*; and the driving force transmission is performed between the driving force receiving opening 12 and the photosensitive member 11 through the transmission part 11*b* and the stressed columns 11*f*. When the driving force receiving opening 12 rotates, the transmission part 12*b* meets the stress of the stressed columns 11*f*, and the driving force receiving opening 12 transmits the driving force to the photosensitive member 11 through the transmission part 12*b* to drive the photosensitive member 11 to perform rotational movement.

Figure 12:
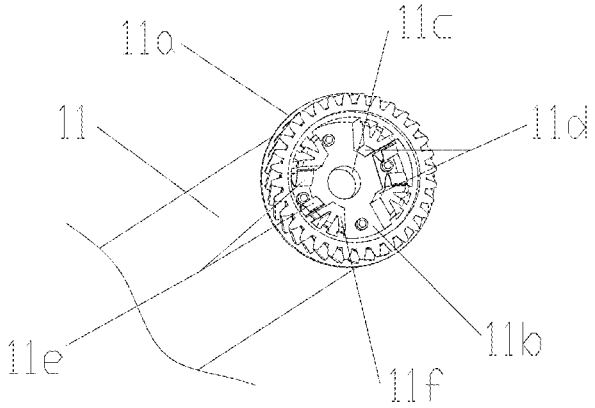
FIG. 12 is a stereogram of the photosensitive member for the process cartridge illustrated in FIG. 1 when the driving force receiving opening is not arranged on the photosensitive member.

As illustrated in FIGS. 8, 10 and 12, the first guide post 12*c* is arranged on the first guide groove 11*c*; the second guide post 12*d* is arranged on the second guide groove 11*d*; and the first guide post 12*c* and the second guide post 12*d* can respectively slide, in the axial direction of the photosensitive member 11 (namely the Y direction), on the first guide groove 11*c* and the second guide groove 11*d*.

The first guide post 12*c*, the second guide post 12*d*, the first guide groove 11*c*, the second guide groove 11*d*, the transmission part 12*b*, the stressed columns 11*f* and the second spring 16 are combined into a retractable mechanism.

Figure 4:
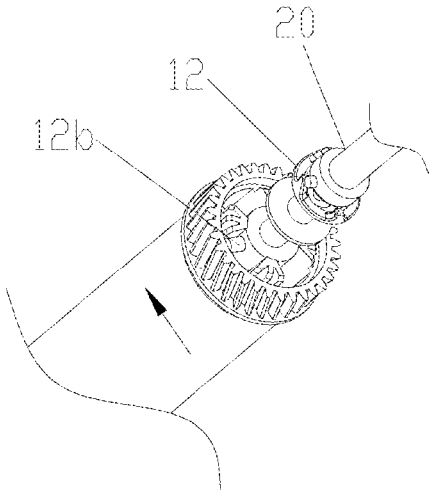
FIG. 4 is a stereogram of a first possible limiting position during the engagement of the driving force receiving opening for the process cartridge and a driving head for an image forming device when no steel plates are arranged between stressed columns in the first embodiment of the invention.
Figure 5:
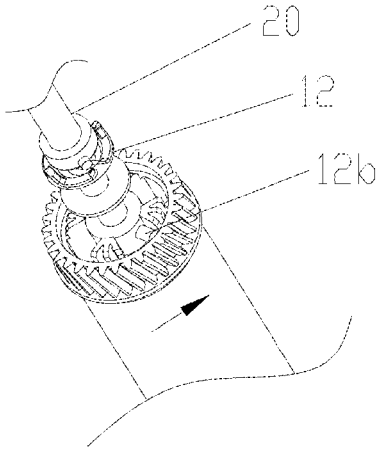
FIG. 5 is a stereogram of a second possible limiting position during the engagement of the driving force receiving opening for the process cartridge and the driving head for the image forming device when no steel plates are arranged between the stressed columns in the first embodiment of the invention.

FIGS. 4 and 5 illustrate two conditions where dead angles occur when no steel plates 11*e* are arranged on the photosensitive member 11, when the driving force receiving opening and the driving mechanism 20 on the image forming device are engaged with each other. As illustrated in FIGS. 4 and 5, when the dead angles occur during the engagement of the driving force receiving opening 12 and the driving mechanism 20, the driving force receiving opening 12 cannot be normally engaged with the driving mechanism 20 as the driving force receiving opening 12 cannot rotate on the photosensitive member 11 along the illustrated direction. The two conditions can result in the fact that the driving force receiving opening cannot operate normally.

Figure 3:
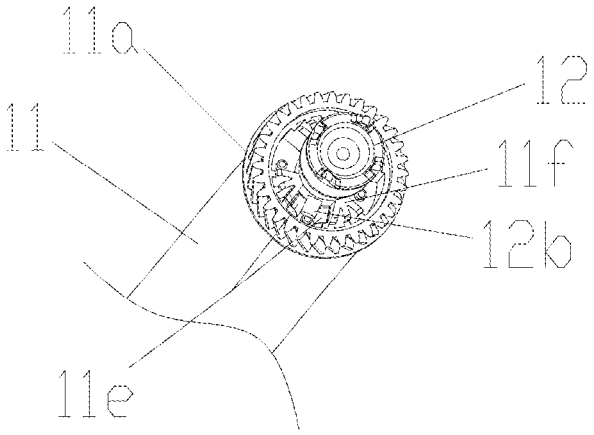
FIG. 3 is a stereogram illustrating a connecting structure of a photosensitive member and a driving force receiving opening for the process cartridge in the first embodiment of the invention.

As illustrated in FIG. 3, when the driving force receiving opening 12 is arranged on the photosensitive member 11, the transmission part 12*b* is arranged between the steel plates between the stressed columns 11*f*. When the driving force receiving opening 12 is engaged with the driving mechanism 20 on the image forming device, the transmission part 12*b* is always arranged between the steel plates 11*b*, so as to guarantee that the dead angles cannot occur when the driving force receiving opening 12 is engaged with the driving mechanism 20.

The embodiment can also be as follows: one end of the spring 16 contacts the driving force receiving opening 12 while the other end of the spring 16 contacts the process cartridge housing 10; and the driving force receiving opening is disengaged with the driving mechanism under the action of the elastic force of the spring.

Second Embodiment

In the above embodiment, only the driving force receiving opening 12 can be driven by the press rod 13 to extend or retract in the axial direction of the photosensitive member 11 so as to engage or disengage with the driving mechanism 20 on the image forming device. It can be understood that a retractable mechanism in this embodiment can also adopt the mode that a driving force receiving opening 12 and a photosensitive member 11 are integrated into a whole and extended or retracted together, and the engagement and disengagement of the driving force receiving opening 12 and the driving mechanism 20 on the image forming device is controlled by a press rod 13. The structures which are the same with those of the first embodiment (such as a control mechanism) are not described in detail here.

The structure and the working process of the retractable mechanism are as follows:

As illustrated in FIG. 9, a shaft pin 14 and a support 17 are arranged on a process cartridge housing 10; a flange 11*a* at one end of the photosensitive member 11 is supported by the shaft pin 14 and a flange 11*a* at the other end of the photosensitive member 11 is supported by the support 17; and the photosensitive member 11 can move along the axial direction of the photosensitive member together with the driving force receiving opening 12. The retractable mechanism adopted in the embodiment comprises the shaft pin 14, the support 17 and the flanges 11*a* at both ends of the photosensitive member 11.

Figure 13:
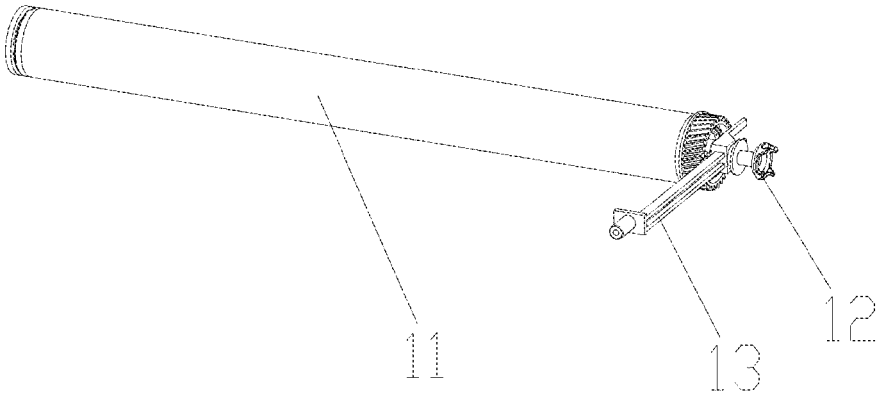
FIG. 13 is a schematic diagram illustrating the state when a press rod make the photosensitive member and the driving force receiving opening to extend or retract in a second embodiment of the invention.
Figure 14:
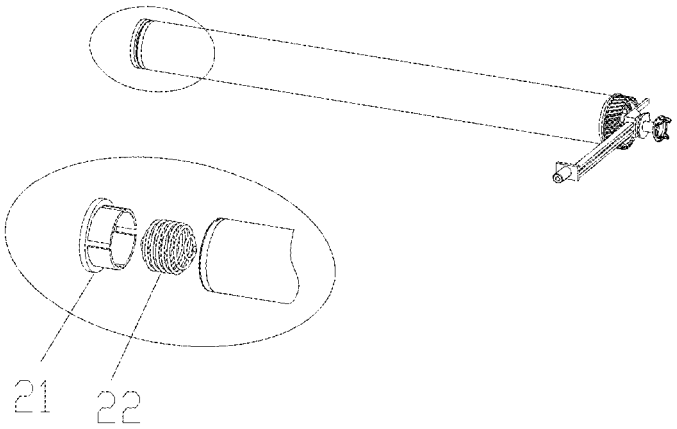
FIG. 14 is a partial enlarged view of an end of the photosensitive member in the second embodiment of the invention where the tension spring is disposed.

As illustrated in FIGS. 13 and 14, a top plate 21 and a tension spring 22 are arranged at one end of the photosensitive member; the driving force receiving opening 12 at the other end of the photosensitive member is fixed on the photosensitive member flange 11*a*; the top plate 21 is fixed on the process cartridge housing 10; and one end of the tension spring 22 is fixed on the top plate 21 while the other end of the tension spring 22 is fixed on the photosensitive member 11. When the press rod 13 moves along the X direction and the driving force receiving opening 12 moves along the Y direction, the driving force receiving opening 12 is extended in the Y direction together with the photosensitive member 11 and engaged with the driving mechanism 20 on the image forming device, and the tension spring 22 at the other end of the photosensitive member 11 is in the stretched state. When the press rod 13 is restored along the direction opposite to the X direction, the driving force receiving opening 12 moves along the direction opposite to the Y direction together with the photosensitive member 11 under the action of the tension spring 22 and is disengaged with the driving mechanism 20 on the image forming device.

Third Embodiment

The structure and the operating process of a retractable mechanism in the embodiment, which is the same with those of the first and second embodiments, are not repeated here.

Figure 15:
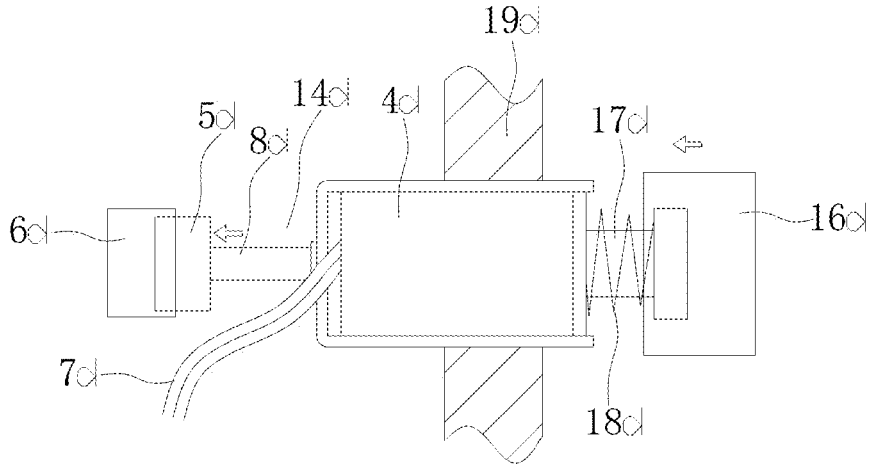
FIG. 15 is a schematic diagram illustrating the state when a driving force receiving opening and a driving mechanism are connected with each other when a third embodiment of the invention is in the power-on state.

In the invention, the retraction of the driving force receiving opening can not only be realized by a mechanical press mode but also can be controlled by an electromechanical mode. The implementation of a control mechanism is as follows:

As illustrated in FIG. 15, the embodiment adopts a single-coil solenoid valve 4*d* to control the engagement and disengagement of a driving force receiving opening 5*d* at the driven side of a connecter 14*d* and a driving mechanism 6*d* of an image forming device. The driving force receiving opening 5*d* is arranged at one end of a shaft 8*d* of the connector 14*d*, and the other end of the shaft 8*d* of the connector 14*d* passes through a hollow cylinder of the solenoid valve 4*d* and can move left or right relative to the solenoid valve; the solenoid valve 4*d* is fixed on a process cartridge housing 19*d* and does not move when the shaft 8*d* slides; one end of a metallic A core 17*d* and the shaft 8*d* are integrated into a whole, and the other end of the metallic A core 17*d* can slide back and forth in a groove arranged at a gear end of a photosensitive member 16*d*; the metallic A core can adopt various structural shapes and can be disc-shaped, cross-shaped, spherical, etc, as long as the metallic A core can slide in the groove arranged, at the gear end of the photosensitive member, corresponding to the shape of the A core; the metallic A core 17*d* can transmit a driving force to the photosensitive member 16*d* and rotate together with the photosensitive member 16*d*; a second elastic component 18*d* is arranged between the solenoid valve 4*d* and the A core 17*d* and provides an elastic restoring force for the A core, wherein the elastic restoring force is used for restoring the A core after the solenoid valve is in the power-off state; and the solenoid valve 4*d* is connected with an external power source through a connection 7*d*.

Figure 16:
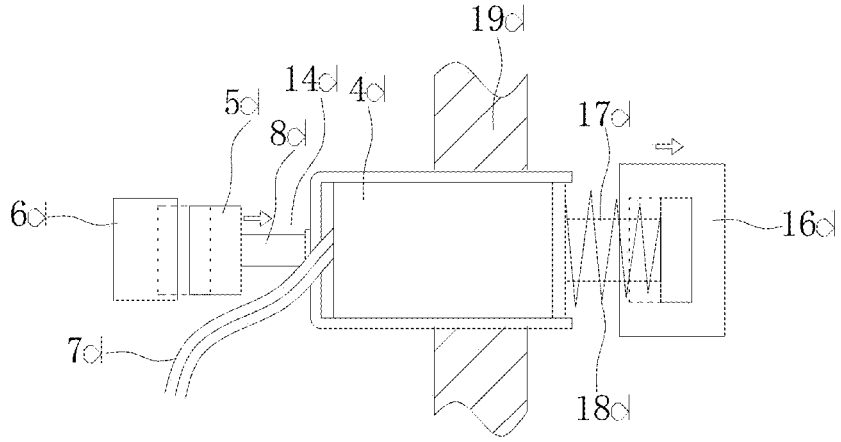
FIG. 16 is a schematic diagram illustrating the state when the driving force receiving opening and the driving mechanism do not contact each other when the third embodiment of the invention is in the power-off state.
Figure 17:
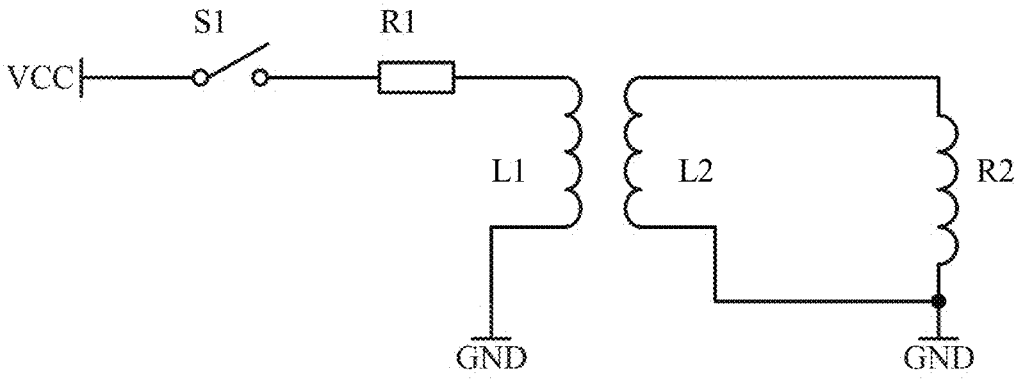
FIG. 17 is a schematic diagram of an operating circuit of the third embodiment of the invention.

The embodiment adopts the electromechanical mode to control the engagement and disengagement of the driving force receiving opening 5*d* and the driving mechanism 6*d* for the image forming device. FIG. 17 is a schematic diagram of a control circuit. When the coil circuit of the solenoid valve is turned on, the power-on coil will generate a magnetic field and generate a magnetic force to the metallic A core 17*d* due to the electromagnetic induction; the magnetic force overcomes an elastic force of the second elastic component 18*d* and attracts the A core 17*d* to be close to the solenoid valve; and the A core 17*d* moves left together with the shaft 8*d*, so that the driving force receiving opening 5*d* fixed at the driven side of the connector is extended through the shaft 8*d* and engaged with the driving mechanism 6*d* for the image forming device, thus the transmission of a rotary force is realized. When the circuit of the solenoid valve is turned off, the coil is powered off without magnetic field generated and has no magnetic attraction to the metallic A core 17*d* accordingly, as illustrated in FIG. 16, the metallic A core 17*d* is driven to slide to the direction far away from the solenoid valve under the action of the elastic force of the second elastic component 18*d*; and meanwhile, the driving force receiving opening 5*d* is drawn by the shaft 8*d* of the connector 14*d* to slide to the direction of the solenoid valve, so that the driving force receiving opening 5*d* is disengaged with the driving mechanism 6*d* for the image forming device. Therefore, the engagement and disengagement of the driving force receiving opening 5*d* and the driving mechanism 6*d* for the image forming device is well realized through the on-off control of the circuit of the solenoid valve.

The operating power source of the solenoid valve in the embodiment comes from the image forming device. As both the operating voltage and the operating current of the solenoid valve are low, a transformer for reducing the voltage and increasing the current is required to be added in the circuit. As illustrated in FIG. 17, Vcc is the power source for the image forming device; R1 is a protective resistance; R2 is an impedance of the coil of the solenoid valve; L1 and L2 are respectively primary and secondary coils of the transformer; and the on-off state of the circuit is controlled by a switch Si.

Figure 18:
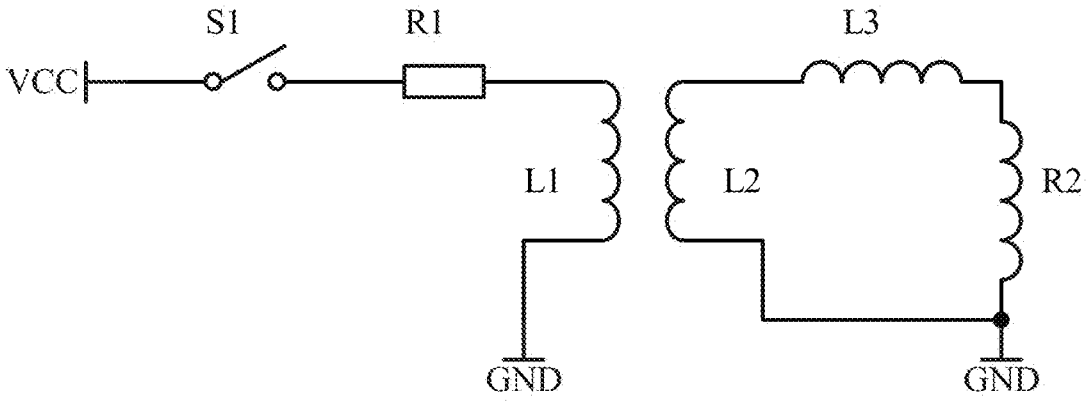
FIG. 18 is a schematic diagram of another operating circuit of the third embodiment of the invention.

The solenoid valve of the embodiment can also be power-on through direct current. As illustrated in FIG. 18, an inductor L3 for removing alternating current is required to be added in the circuit.

The switch S1 in the circuit of the embodiment can be arranged inside a primary coil circuit and can also be arranged inside a secondary coil circuit as long as the on-off control of the control circuit can be achieved.

Fourth Embodiment

Figure 19:
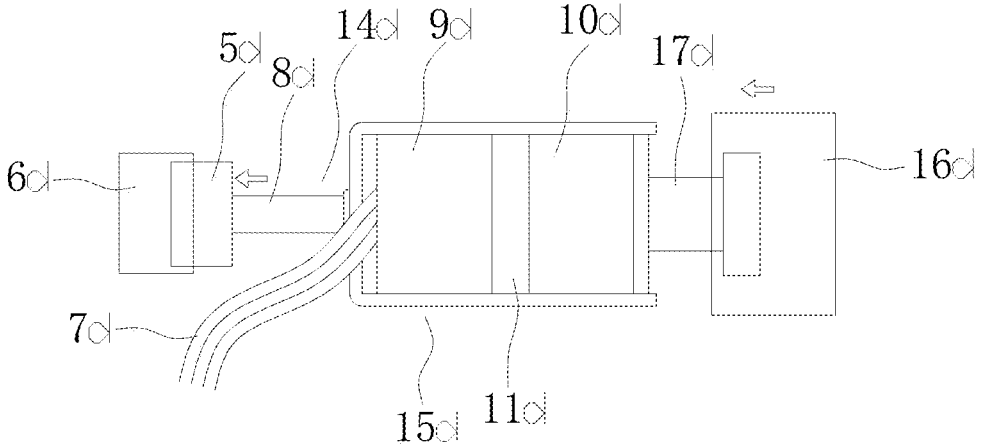
FIG. 19 is a schematic diagram illustrating the state when a driving force receiving opening and a driving mechanism are connected with each other when a fourth embodiment of the invention is in the power-on state.

The third embodiment utilizes the single-coil solenoid valve to control the extension and retraction of the driving force receiving opening. The invention can also utilize a double-coil solenoid valve to achieve the same effect. The detailed description of another embodiment of the control mechanism is as follows:

As illustrated in FIG. 19, the embodiment adopts the double-coil solenoid valve 15*d* to control the engagement and disengagement of a driving force receiving opening 5*d* at the driven side of a connector 14*d* and a driving mechanism 6*d* on an image forming device. The structures which are the same with those of the third embodiment are not described in detail here. The differences between the embodiment and the third embodiment are as follows: the solenoid valve of the embodiment is formed by two coils, namely a first coil 9*d* and a second coil 10*d*; a magnet 11*d* is arranged between the two coils and fixed on the solenoid valve and does not contact the two coils; and no elastic component is arranged between the solenoid valve 15*d* and a metallic A core of the embodiment. In the embodiment, the first coil 9*d* and the second coil 10*d* do not operate at the same time; and the condition that only one coil between the coils operates or both coils do not operate can be controlled by a circuit at any moment, but the condition that both coils operate at the same time cannot occur. Moreover, the coils in the embodiment are subjected to instantaneous power, and the POH (Power On Hours) is 3 seconds or less.

Figure 20:
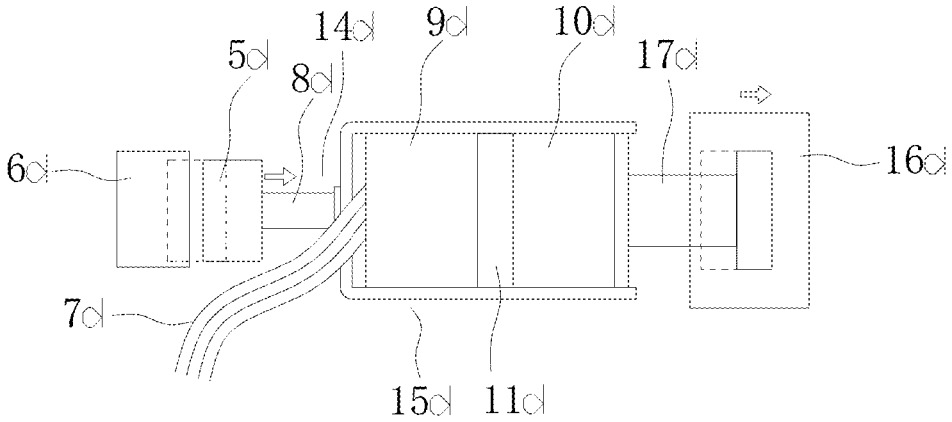
FIG. 20 is a schematic diagram illustrating the state when the driving force receiving opening and the driving mechanism do not contact each other when the fourth embodiment of the invention is in the power-off state.
Figure 21:
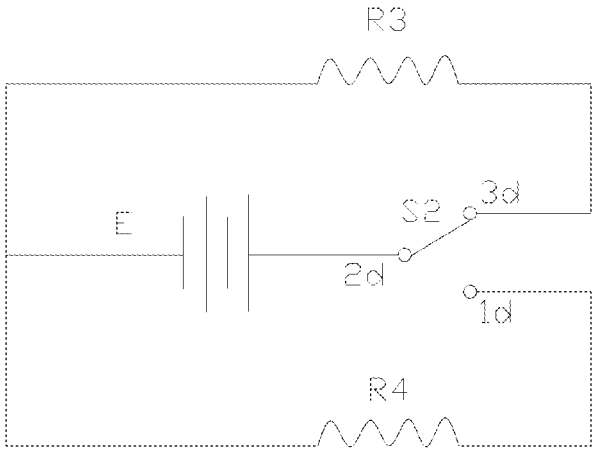
FIG. 21 is a schematic diagram of an operating circuit of the fourth embodiment of the invention.

As illustrated in FIG. 21, the on-off state of the first coil 9*d* and the second coil 10*d* is controlled by SPDT (single-pole double-throw) switch in the circuit. When the first coil 9*d* is turned on, due to the electromagnetic induction, the power-on coil will generate a magnetic field and generate a magnetic force to a metallic A core 17*d*, so as to attract the A core 17*d* to be close to the solenoid valve, thus the driving force receiving opening 5*d* fixed at the driven side of a connector is extended through a shaft 8*d* and engaged with a driving mechanism 6*d* for an image forming device. As the coils of the embodiment are subjected to instantaneous power, the attractive force of the first coil 9*d* to the metallic A core 2 will disappear after the coils are turned on. In order to guarantee that the driving force receiving opening 5*d* can continue to be closely engaged with the driving mechanism 6*d* for the image forming device, the shaft 8*d* of the connector is attracted by a magnet 11*d* on the solenoid valve to be fixed at a position, at which the driving force receiving opening 5*d* is maintained to be engaged with the driving mechanism 6*d* for the image forming device. When the second coil 10*d* is turned on, due to the electromagnetic induction, the power-on coil will generate a magnetic field, but the directions of the magnetic fields generated by the two coils are opposite to each other as the first coil 9*d* and the second coil 10*d* share a positive electrode of the power source. Therefore, the magnetic force of the magnetic field generated by the second coil 10*d* to the metallic A core 17*d* will drive the connector to perform restoring movement. That is to say, as illustrated in FIG. 20, the metallic A core 17*d* slides to the direction far away from the solenoid valve but a driving head slides to the direction close to the solenoid valve; and the magnet 11*d* attracts the shaft 8*d* again to keep the shaft 8*d* to be at a position, at which the driving force receiving opening 5*d* is disengaged with the driving mechanism 6*d* for the image forming device. Therefore, the engagement and disengagement of the driving force receiving opening 5*d* and the driving mechanism 6*d* for the image forming device is well realized through the on-off control of the circuit of the solenoid valve.

The operating power source of the solenoid valve in the embodiment comes from dry cells added on the process cartridge. As illustrated in FIG. 21, E is a dry cell battery pack; a SPDT (single-pole double-throw) S2 controls the first coil 9*d* and the second coil 10*d* to be powered on respectively; and R3 and R4 are respectively impedances of the first coil 9*d* and the second coil 10*d*.

The embodiment can also be as follows: when the second coil 10*d* is turned on, the A core 17*d* is attracted to be close to the direction of the solenoid valve; and when the first coil 9*d* is turned on, a repulsive force is generated to drive the metallic A core 17*d* to slide to the direction far away from the solenoid valve. That is to say, users only need to guarantee that only one coil between the first coil 9*d* and the second coil 10*d* operates or both coils do not operate at any moment.

Fifth Embodiment

The structures of the embodiment are basically the same with those of the first embodiment, so the structures which are the same with those of the first embodiment (such as a retractable mechanism) are not described in detail here.

Figure 22:
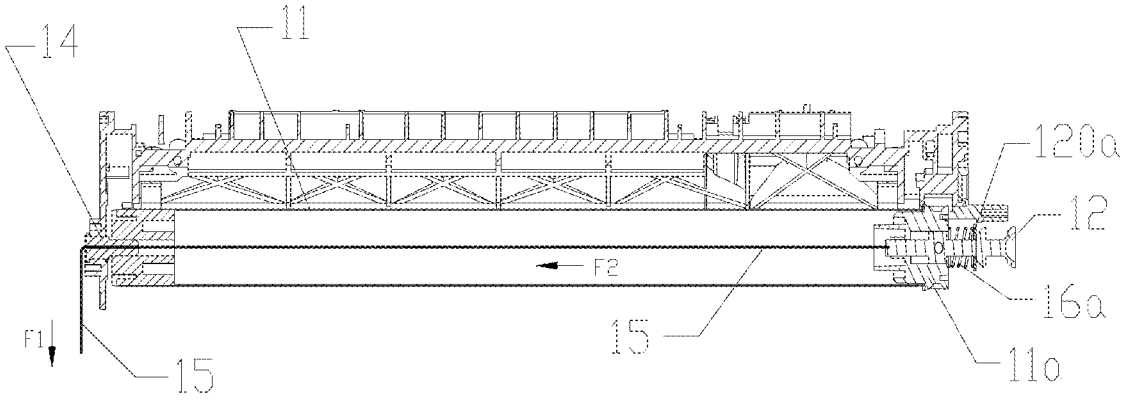
FIG. 22 is a section view of a fifth embodiment of the invention.
Figure 23:
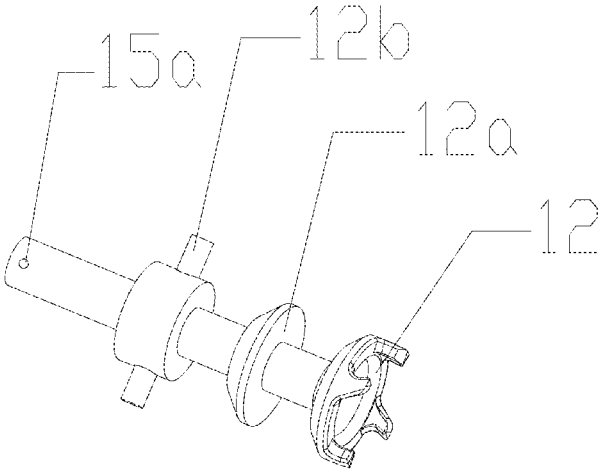
FIG. 23 is a stereogram of a driving force receiving opening of the fifth embodiment of the invention.
Figure 24:
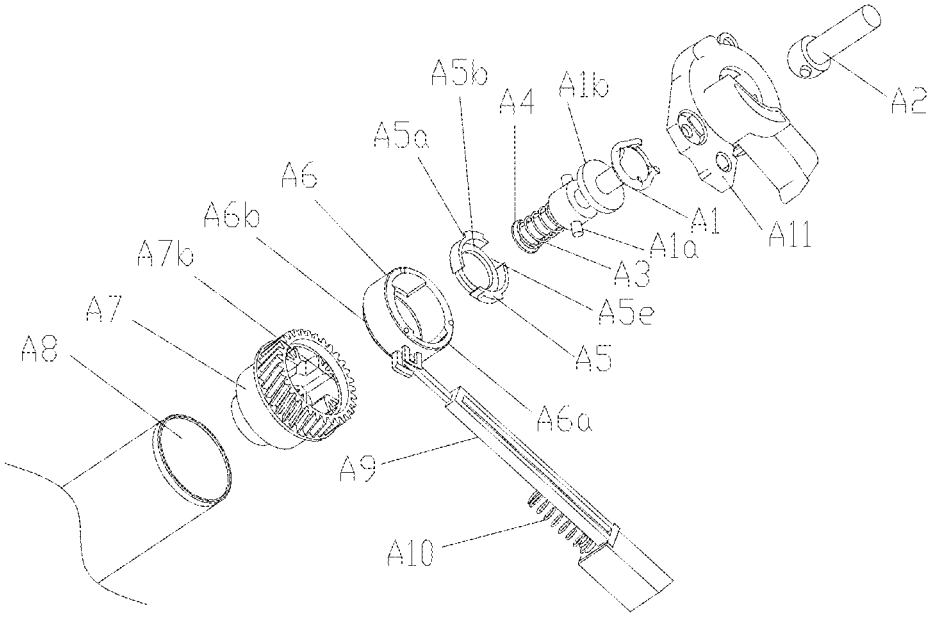
FIG. 24 is an exploded view of a driving force transmission mechanism for a photosensitive member in a sixth embodiment of the invention.
Figure 25:
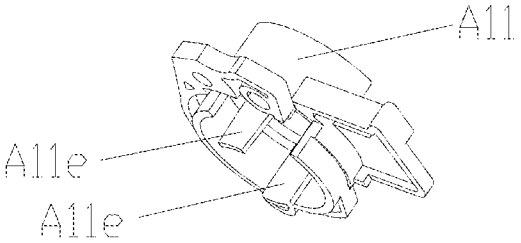
FIG. 25 is a stereogram of an end cover of the driving force transmission mechanism for the photosensitive member in the sixth embodiment of the invention.
Figure 26:
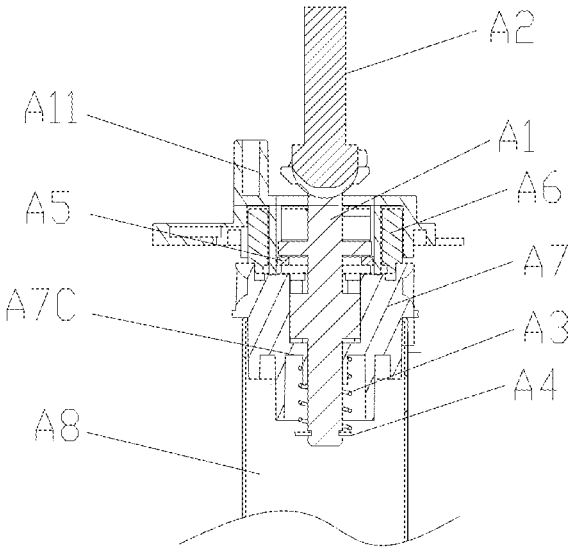
FIG. 26 is a section view of the driving force transmission mechanism for the photosensitive member in the sixth embodiment of the invention.

A control mechanism adopted by the embodiment is as follows:

FIG. 22 is a section view of a process cartridge of the embodiment. In the embodiment, a guy 15 passing through a shaft pin 14 on a process cartridge housing 10, is connected with a driving force receiving opening 12, and can slide in a photosensitive member 11 along the axial direction of the photosensitive member 11; the driving force receiving opening 12 is arranged on a flange 11*a* for the photosensitive member 11 (the connection means and the driving force transmission mode are the same with those of the first embodiment); a press fastener 120*a* is arranged on the driving force receiving opening 12; one end of a second spring 16*a* contacts the flange 11*a* while the other end of the second spring 16*a* contacts the press fastener 120*a*; and the second spring 16*a* is a pressure spring.

As illustrated in FIG. 22, when the process cartridge is arranged on an image forming device, a tensile force F1 is applied to the guy 15 in the direction perpendicular to the axial direction of the photosensitive member. Due to the characteristic of the guy, the tensile force F1 born by the guy 15 is transferred into a tensile force F2 along the axial direction. Herein, the tensile force F2 makes the driving force receiving opening 12 to move left, and the second spring 16*a* is in the compressed state. When the tensile force F1 is cancelled, the second spring 16*a* is restored and makes the driving force receiving opening 12 to move right, and herein the driving force receiving opening 12 is engaged with a driving mechanism on the image forming device. When the process cartridge is disengaged with the image forming device, the guy 15 bears the tensile force F1 again, and the driving force receiving opening 12 is made to move left and be disengaged with the driving mechanism.

The tensile force F1 in the embodiment can be transmitted from the outside, such as a handle of the process cartridge. One end of the guy 15 is connected with the handle while the other end of the guy 15 is connected with the driving force receiving opening 12. When the handle of the process cartridge is stretched, the guy 15 is stretched together with the handle and receives the tensile force F1 from the handle herein, and the driving force receiving opening is made to move left. When the handle of the process cartridge is not stretched, the guy 15 does not bear the tensile force F1 anymore and the second spring 16*a* makes the driving force receiving opening 12 to move right.

The guy 15 of the embodiment can also be arranged on the process cartridge housing 10 which supports the photosensitive member 11.

In the invention, other elastic materials (such as elastic rubber and elastic steel plate) can be used to replace the spring, and the same technical effect can be achieved as well. The elastic materials and the spring are known as elastic components. Therefore, the first and second springs in the first embodiment are also known as the first and second elastic components, and the second spring in the third, fourth and fifth embodiment can also be known as the second elastic component.

A developer is accommodated in the process cartridge in the above embodiments, and the process cartridge is also provided with developing components for realizing the development of the photosensitive member, a cleaning component, a charging component and so on. No detailed description is given here.

Sixth Embodiment

The structures in the embodiment which are the same with those of the first embodiment are not described in detail here.

Figure 27:
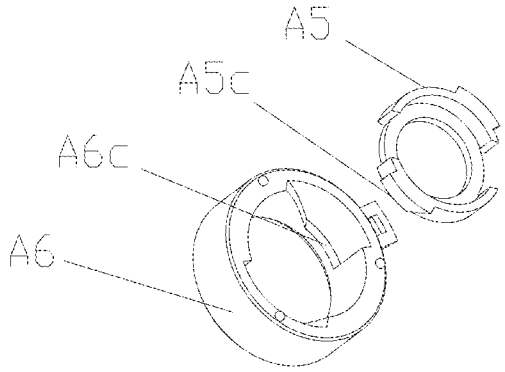
FIG. 27 is an exploded view of a centering ring and a guide sleeve in the driving force transmission mechanism for the photosensitive member in the sixth embodiment of the invention.
Figure 28:
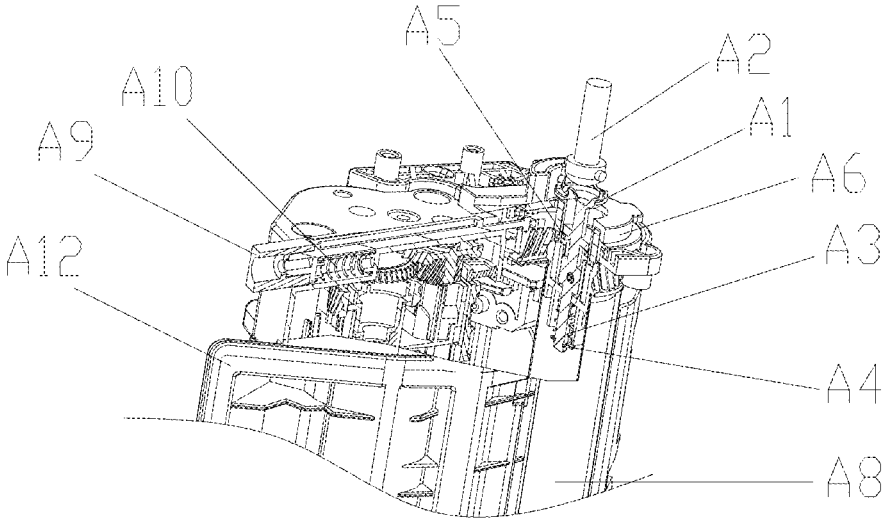
FIG. 28 is a partial section view of a toner cartridge before the driving force receiving opening of the driving force transmission mechanism for the photosensitive member in the sixth embodiment of the invention is engaged with a driving head for an image forming device.
Figure 29:
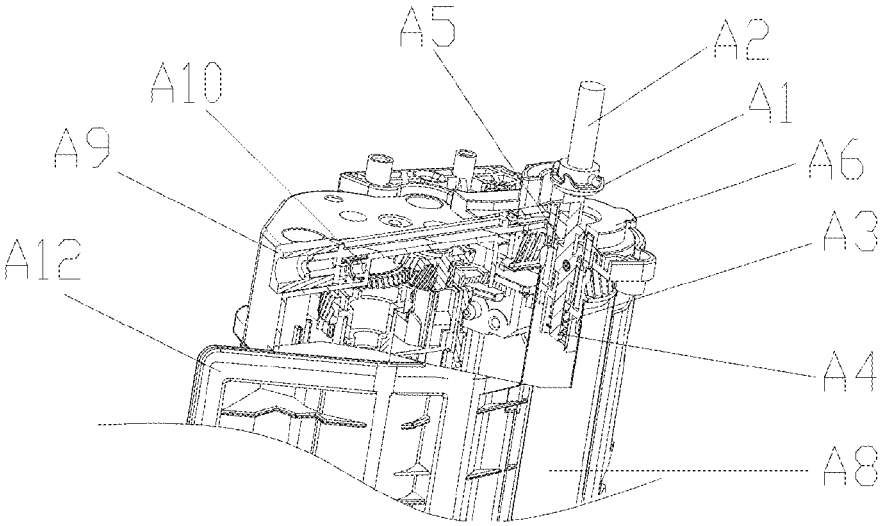
FIG. 29 is a partial section view of a toner cartridge after the driving force receiving opening of the driving force transmission mechanism for the photosensitive member in the sixth embodiment of the invention is engaged with the driving head for the image forming device.

As illustrated in FIGS. 24 to 27, a driving force transmission mechanism for the photosensitive member comprises a driving mechanism A2 (equivalent to a printer driving head described in the Chinese patent application CN2010101313861), a driving force receiving opening A1, a second spring A3, a press fastener A4, a guide sleeve A5, a centering ring A6, a photosensitive member flange A7, a press rod A9, a first spring A10 and a flange A11 (equivalent to an end cover described in the Chinese patent application CN2010101313861), wherein the driving force receiving opening A1, the guide sleeve A5, the centering ring A6 and the photosensitive member flange A7 are connected with each other in turn; the driving force receiving opening A1 is engaged with the driving mechanism A2 and receives a rotational driving force from the driving mechanism A2; a driving force transmission part A1*a* which is also arranged on the driving force receiving opening A1, is engaged with the photosensitive member flange A7, transmitting the rotational driving force from the driving mechanism A2 to the photosensitive member flange A7, and providing the rotational driving force for the photosensitive member flange A7; a circular boss A1*b* is also arranged on the driving force receiving opening A1; a driving force receiving opening support base A5*b* is arranged on the guide sleeve A5; the circular boss A1*b* is arranged on the driving force receiving opening support base A5*b* and can rotate freely relative to the driving force receiving opening support base A5*b*, so that the driving force receiving opening A1 can rotate freely relative to the guide sleeve A5; a boss A5*c* and an axial limiting interface A5*e* are arranged on the guide sleeve A5; a guide sleeve support base A6*c* is arranged on the centering ring A6; the boss A5*c* is arranged on the guide sleeve support base A6*c*; the guide sleeve support base A6*c* has height difference in the axial direction of the photosensitive member as illustrated in FIG. 27; clamping blocks A11*e* are arranged on the flange A11 and arranged inside the axial limiting interface A5*e* and used for limiting the rotational movement of the guide sleeve A5; when the guide sleeve support base A6*c* moves relative to the boss A5*c*, the guide sleeve A5 is driven to move along the axial direction of the photosensitive member and then the driving force receiving opening A1 is driven to move along the axial direction of the photosensitive member; a boss A6*b* is arranged on the centering ring A6; a limiting groove A7*c* for the second spring A3 and a limiting groove A7*b* for the centering ring A6 are arranged on the photosensitive member flange A7; the boss A6*b* is arranged inside the limiting groove A7*b* for the centering ring A6 and driven to rotate freely on the limiting groove A7*b* for the centering ring A6, and then the photosensitive member A8 can rotate freely relative to the centering ring A6; the driving mechanism A2 and the driving force receiving opening A1 are engaged with each other for the driving force transmission; the press fastener A4 is arranged at one end of the driving force receiving opening A1; the second spring A3 is arranged between the press fastener A4 and the limiting groove A7*c* for the second spring A3; one end of the first spring A10 is arranged on the press rod A9 while the other end of the first spring A10 is arranged on a toner cartridge A12; the press rod A9 is connected with the centering ring A6; the photosensitive member A8 is connected with the photosensitive member flange A7; and the guide sleeve A5 and the driving force receiving opening A1 are connected with the centering ring A6 by axial sliding.

A retractable mechanism comprises the driving force transmission part A1*a*, the press fastener A4 and the second spring A3, and a control mechanism comprises the circular boss A1*b*, the guide sleeve A5, the centering ring A6, the press rod A9, the first spring A10 and the flange A11.

The driving force transmission process of the whole driving force transmission mechanism in the embodiment is described in detail as follows. As illustrated from FIGS. 24 to 29, the driving force receiving opening A1 and the driving mechanism A2 are in the disengaged state during the installation of the toner cartridge A12 and are still kept for certain distance when the toner cartridge A12 is installed in place. After the toner cartridge A12 is installed and when a machine cover is closed, the press rod A9 is pushed by the machine cover of the image forming device (equivalent to a printer described in the Chinese patent application CN201010131386.1) to make the centering ring A6 connected with the press rod A9 rotate clockwise along the radial direction of the photosensitive member. As the rotational movement of the guide sleeve is avoided due to the connection of the clamping blocks A11*e* on the flange A11 and the axial limiting interface A5*e* of the guide sleeve, the guide sleeve A5 can be driven, by the centering ring A6 through axial thrust generated by a centering ring bevel A6*a* and a guide sleeve bevel A5*a*, to extend along the axial direction of the photosensitive member, thus the driving force receiving opening A1 arranged on the guide sleeve A5 is driven to be extended and engaged with the driving mechanism A2, consequently the driving mechanism A2 makes the driving force receiving opening A1 to drive the photosensitive drum A8 to rotate along the axial direction of the photosensitive drum A8. Herein, both the second spring A3 and the first spring A10 are in the compressed state, and the axial extended travel of the driving force receiving opening A1 in the state is between 3.8 and 4.8 mm compared with that in the state before the machine cover for the image forming device is closed. After the printing process is completed and when the machine cover for the image forming device is opened, the pressure applied to the press rod A9 by the machine cover for the image forming device is canceled, and the press rod A9 with the restoring function is retracted under the action of an acting force of the first spring A10, so as to make the centering ring A6 to rotate counterclockwise along the radial direction of the centering ring A6; the axial thrust between the centering ring bevel A6*a* and the guide sleeve bevel A5*a* is canceled, and the compressed second spring A3 is restored, so as to make the driving force receiving opening A1 to be retracted and disengaged with the driving mechanism A2; and the printing process is completed.

Figure 30:
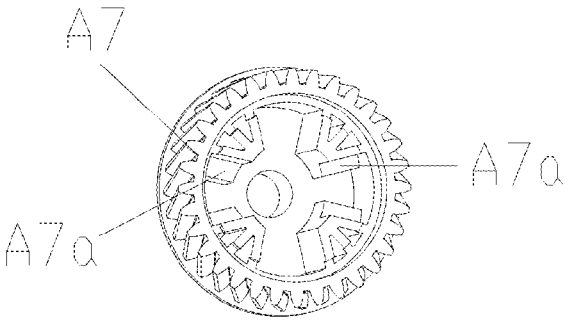
FIG. 30 is a stereogram of a photosensitive member flange of the driving force transmission mechanism for the photosensitive member in the sixth embodiment of the invention.
Figure 31:
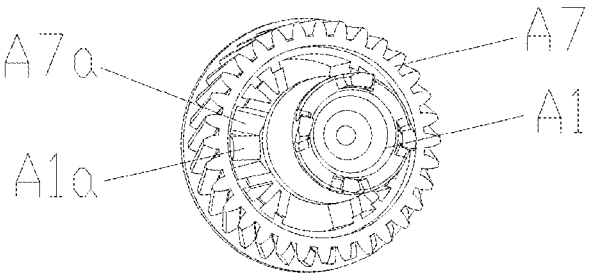
FIG. 31 is a stereogram illustrating the state when the driving force receiving opening of the driving force transmission mechanism for the photosensitive member in the sixth embodiment of the invention is arranged inside the photosensitive member flange.

As illustrated in FIGS. 30 and 31, in the embodiment, a bevel positioning groove A7*a* is arranged inside the photosensitive member flange A7. The driving force transmission part A1*a* of the driving force receiving opening A1 is arranged in the middle of the bevel positioning groove A7*a* before the driving force receiving opening A1 is extended in the axial direction of the photosensitive member and engaged with the driving mechanism A2, so that the driving force receiving opening A1 can be driven to be extended in the axial direction of the photosensitive member and engages with the driving mechanism A2 while aligning with the driving mechanism A2 (the alignment means that the driving force receiving opening A1 rotates a little around the axial direction of the driving force receiving opening A1), thus the phenomenon of meeting dead angles during the engagement of the driving force receiving opening A1 and the driving mechanism A2 is avoided.

In this invention, the process cartridge is the same as the toner cartridge.

Figure 32:
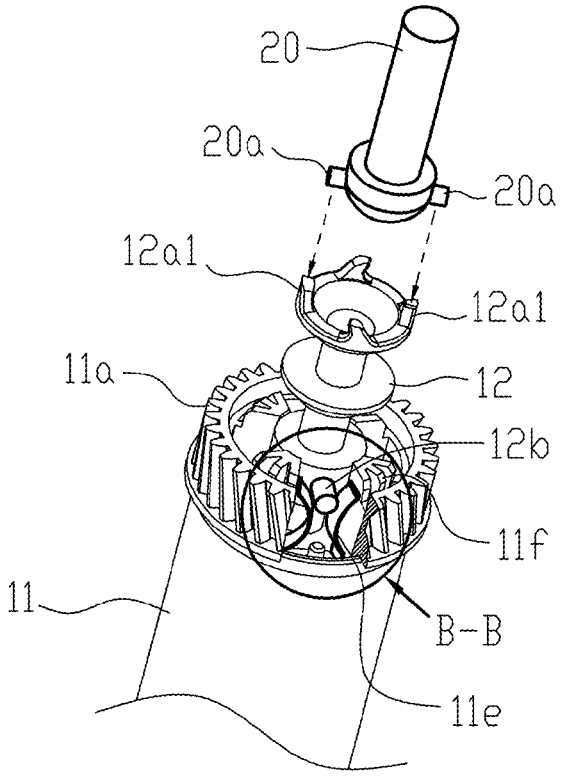
FIG. 32 is a structure schematic diagram of the steel plate disposed in the flange in the first embodiment of the invention.
Figure 33:
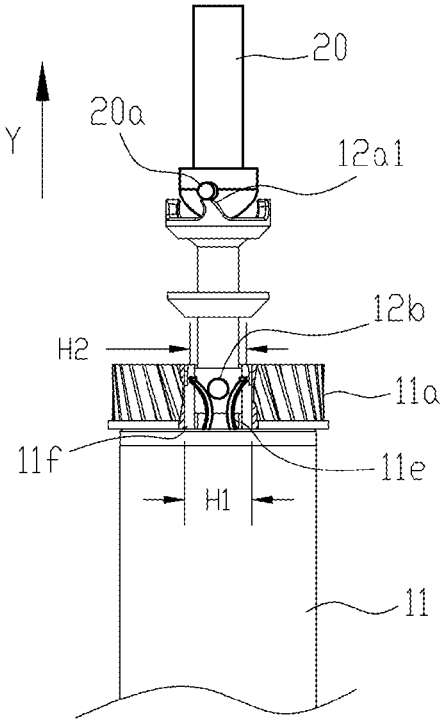
FIG. 33 is a schematic diagram illustrating the structural interference produced between the driving force receiving opening and the driving mechanism when the driving force receiving opening is extended, in the first embodiment of the invention.
Figure 34:
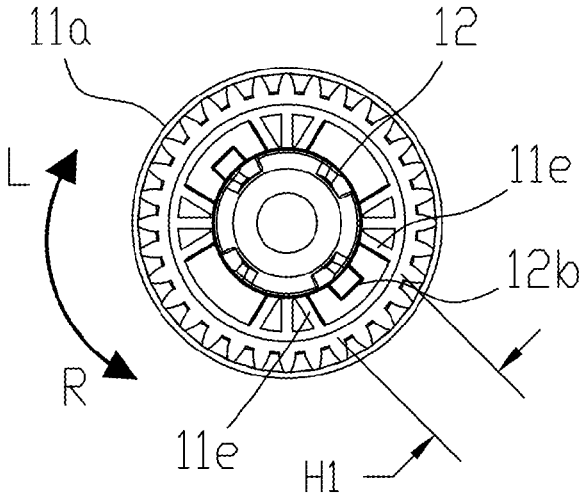
FIG. 34 is a schematic diagram illustrating the action that the driving force receiving opening can partially rotate, in the first embodiment of the invention.

In the first embodiment, as illustrated in FIGS. 3, 10, 11, 12 and 32, the steel plate 11*e* in the flange 11*a* of the photosensitive member 11 is disposed between two stressed columns 11*f*. The steel plate 11*e* is two U-shaped or V-shaped elastic pieces. Similarly, the transmission part 12*b* of the driving force receiving opening 12 mounted in the flange 11*a* is disposed in the steel plate 11*e* (as shown in B-B partial section view of the flange 11*a* in FIG. 32). Due to the urge action of the inclined surface 13*c* to the support base 12*a* of the driving force receiving opening 12, when the driving force receiving opening 12 is extended along the Y direction and engaged with the driving mechanism 20 of the image forming device, as the driving force receiving opening 12 is engaged with the driving mechanism 20 and receives the rotary driving force from the driving mechanism 20, the driving force is transmitted to the driving force receiving opening 12 through the mutual engagement between projections 12*a*1 on the front of the driving force receiving opening 12 and the transmission columns 20*a* of the driving mechanism 20 and the abutting of side faces of the transmission columns 20*a* against side faces of the projections 12*a*1. Thus, when the driving force receiving opening 12 is extended along the Y direction and subjected to contact and engage with the driving mechanism 20, the top of the projections 12*a*1 thereof and the bottom of the transmission columns 20*a* have large possibility to abut against each other to form structural interference. Due to the structural interference between the projections 12*a*1 and the transmission pins 20*a*, the driving force receiving opening 12 cannot be continuously extended along the Y direction to be engaged with the driving mechanism 20. As illustrated in FIGS. 32 to 34, the steel plate 11*e* is disposed between two stressed columns 11*f* in the flange 11*a*, and the transmission part 12*b* of the driving force receiving opening 12 is also disposed between the two stressed columns 11*f*. A space H1 is formed between two stressed columns 11*f*. (the space H1 is greater than or equal to the maximum width H2 of the steel plate 11*e* and greater than the width of the transmission part 12*b*). Thus, the driving force receiving opening 12 mounted in the flange 11*a* can partially rotate towards the counterclockwise direction R or the clockwise direction L relative to the rotation axis thereof. Simultaneously, the steel plate 11*e* disposed in the flange 11*a* make the transmission part 12*b* of the driving force receiving opening 12 being always kept between the two stressed columns 11*f* and does not abut against the stressed columns 11*f*.

Figure 35:
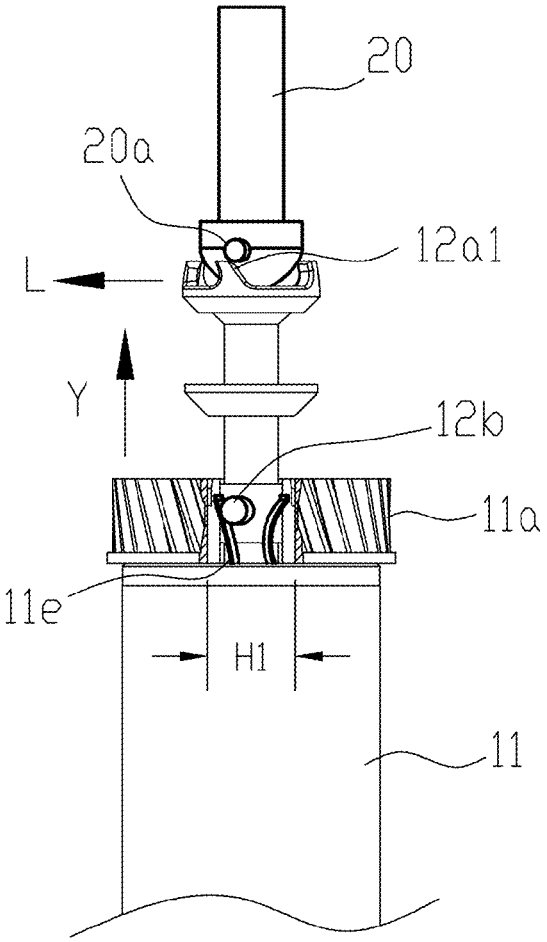
FIG. 35 is a schematic diagram illustrating the elastic deformation of the steel plate in the case of structural interference between the projections and the transmission columns, in the first embodiment of the invention.
Figure 36:
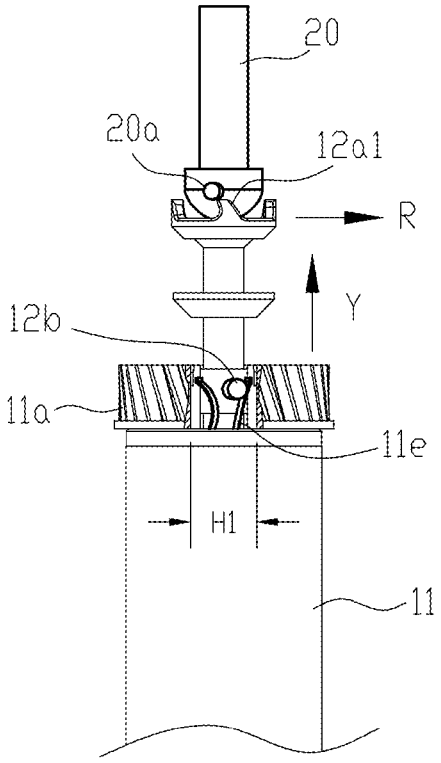
FIG. 36 is a schematic diagram illustrating the elastic deformation of the steel plate in the case of structural interference between the projections and the transmission columns, in the first embodiment of the invention.
Figure 37:
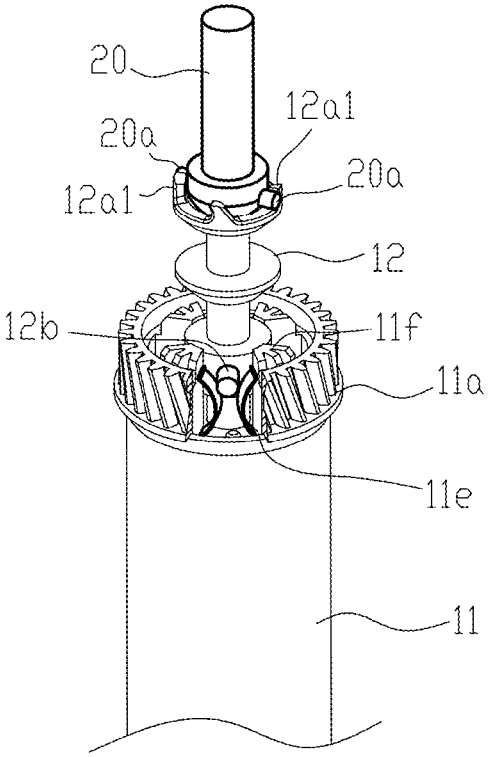
FIG. 37 is a schematic diagram illustrating the contact engagement between the driving force receiving opening and the driving mechanism, in the first embodiment of the invention.

As illustrated in FIGS. 35 and 36, the structural interference produced in the process of contacting and engaging between the projections 12*a*1 on the front of the driving force receiving opening 12 and the transmission columns 20*a* of the driving mechanism 20 has two cases: (1) when the top of the projections 12*a*1 and the bottom of the transmission columns 20*a* abut against each other to form structural interference, as partial movement can be achieved when the transmission part 12*b* of the driving force receiving opening 12 is disposed in the steel plate 11*e* and disposed between the two stressed columns 11*f*, the driving force receiving opening 12 is affected by the mutual abutting and sliding between the projections 12*a*1 and the transmission columns 20*a* and rotates towards the clockwise direction L relative to the rotation axis thereof; in this case, continuous structural interference between the top of the projections 12*a*1 and the bottom of the transmission columns 20*a* can be avoided; and simultaneously, the transmission part 12*b* can abut against one side of the steel plate 11*e* so that the steel plate 11*e* is elastically deformed; and (2) as similar to the case (1), when the driving force receiving opening 12 is affected by the mutual abutting and sliding between the projections 12*a*1 and the transmission columns 20*a* and can rotate towards the counterclockwise direction R relative to the rotation axis thereof, continuous structural interference between the top of the projections 12*a*1 and the bottom of the transmission columns 20*a* can be also avoided; and simultaneously, the transmission part 12*b* can abut against the other side of the steel plate 11*e* so that the steel plate 11*e* is elastically deformed. Finally, when there is no structural interference between the projections 12*a*1 and the transmission columns 20*a*, the driving force receiving opening 12 is continuously extended along the Y direction and engaged with the driving mechanism 20 of the image forming device. Along with the rotation of the driving mechanism 20, the side faces of the transmission columns 20*a* can abut against the side faces of the projections 12*a*1, and the rotary driving force can be transmitted to the driving force receiving opening 12. Along with the rotation of the driving force receiving opening 12, the transmission part 12*b* thereof leans against one side of the steel plate 11*e*, so that the steel plate 11*e* is elastically deformed and abuts against the stressed column 11*f*, and hence the rotary driving force is transmitted to the flange 11*a*, as illustrated in FIG. 37. When the driving force receiving opening 12 is disengaged from the driving mechanism 20, as the transmission part 12*b* is not stressed to abut against the steel plate 11*e*, the elastic force of the steel plate 11*e* is restored, so that the transmission part 12*b* is pushed to the position between the two stressed columns 11*f* and has a clearance with the stressed column 11 and does not make contact with the stressed columns 11. Thus, when the driving force receiving opening 12 makes contact engagement with the driving mechanism 20 again, the driving force receiving opening 12 can partially rotate towards the counterclockwise direction R or the clockwise direction L relative to the rotation axis thereof again, and the structural interference between the projections 12*a*1 and the transmission columns 20*a* can be avoided again.

Figure 38:
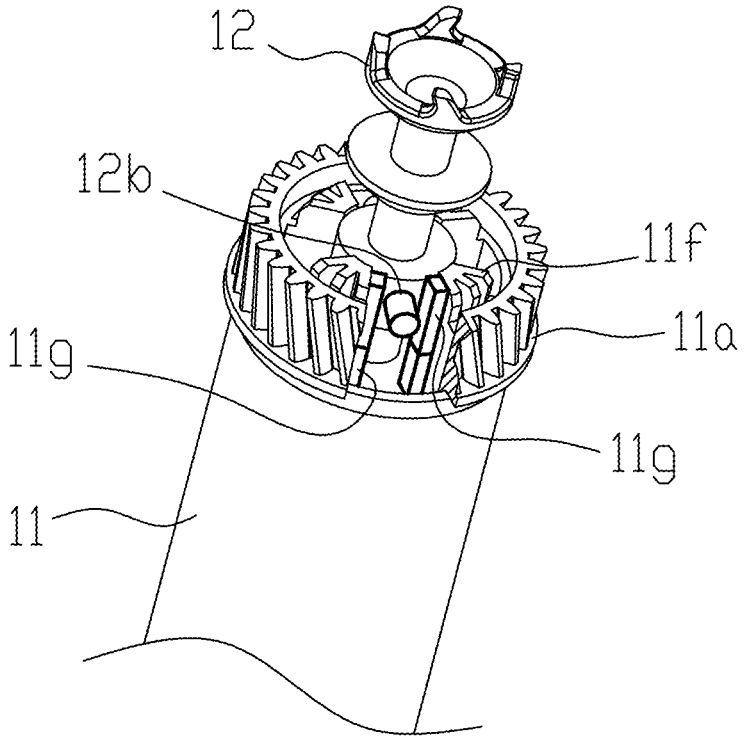
FIG. 38 is a structure schematic diagram of a magnetic member disposed in the flange in the first embodiment of the invention.

In addition, as illustrated in FIG. 38, the steel plate 11*e* in the flange 11*a* may also be replaced by two magnetic members 11*g*; the transmission part 12*b* in the driving force receiving opening 12 is a magnetic cylinder; the two magnetic members 11*g* are respectively arranged on both sides of the transmission part 12*b* and disposed on the two stressed columns 11*f*; when the driving force receiving opening 12 is mounted on the flange 11*a*, the transmission part 12*b* of the driving force receiving opening 12 and corresponding magnetic member 11*g* are arranged on the same pole so as to achieve the effect that like poles repel each other; and both the poles of the transmission part 12*b* and the corresponding magnetic member 11*g* are set to be S poles or N poles. As the two magnetic members 11*g* are disposed between the two stressed columns 11*f*, the transmission part 12*b* with magnetic property is always disposed between the two magnetic members 11*g* due to the action that like poles repel each other, and hence the adjustment function the same with that of the foregoing steel plate 11*e* can be achieved: the transmission part 12*b* is kept between the two stressed columns 11*f*, has a clearance, and does not make contact with the stressed columns 11*f*, and the driving force receiving opening 12 in the flange 11*a* can partially rotate towards the counterclockwise direction R or the clockwise direction L relative to the rotation axis thereof.

Figure 39:
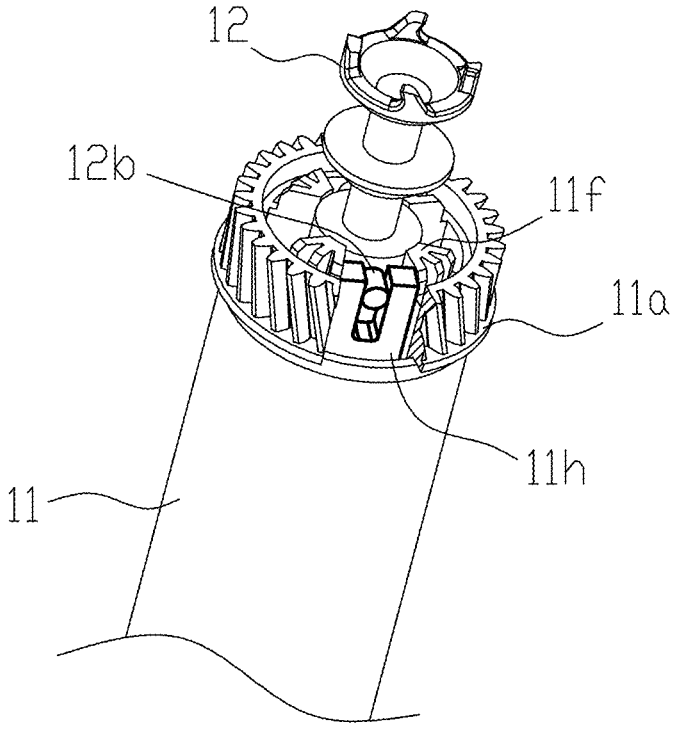
FIG. 39 is a structure schematic diagram of an elastic member disposed in the flange in the first embodiment of the invention.

Moreover, as illustrated in FIG. 39, the steel plate 11*e* in the flange 11*a* may also be replaced by an elastic member 11*h* (e.g., an elastic sponge and an elastic rubber). The elastic member 11*h* may be set to be a pair which are respectively disposed on the two stressed columns 11*f* relative to both sides of the transmission part 12*b*, or the elastic member 11*h* has a U-shaped or V-shaped structure, is disposed between the two stressed columns 11*f*, and is configured to clamp the transmission part 12*b* of the driving force receiving opening 12, and hence the adjustment function the same with that of the forgoing steel plate 11*e* can be achieved: the transmission part 12*b* is kept between the two stressed columns 11*f* and does not make contact with the stressed columns 11*f*, and the driving force receiving opening 12 in the flange 11*a* can partially rotate towards the counterclockwise direction R or the clockwise direction L relative to the rotation axis thereof.

Figure 40:
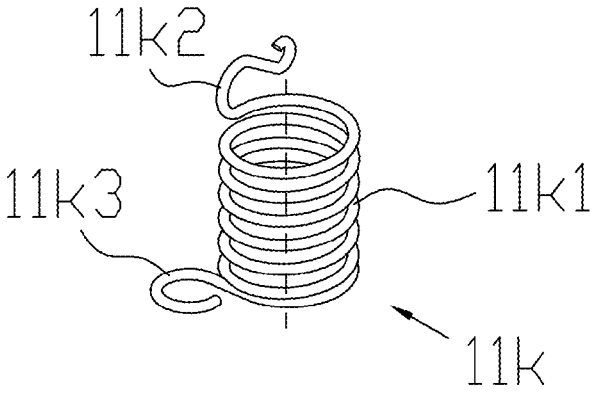
FIG. 40 is a structure schematic diagram of a torsional spring member disposed in the flange in the first embodiment of the invention.
Figure 41:
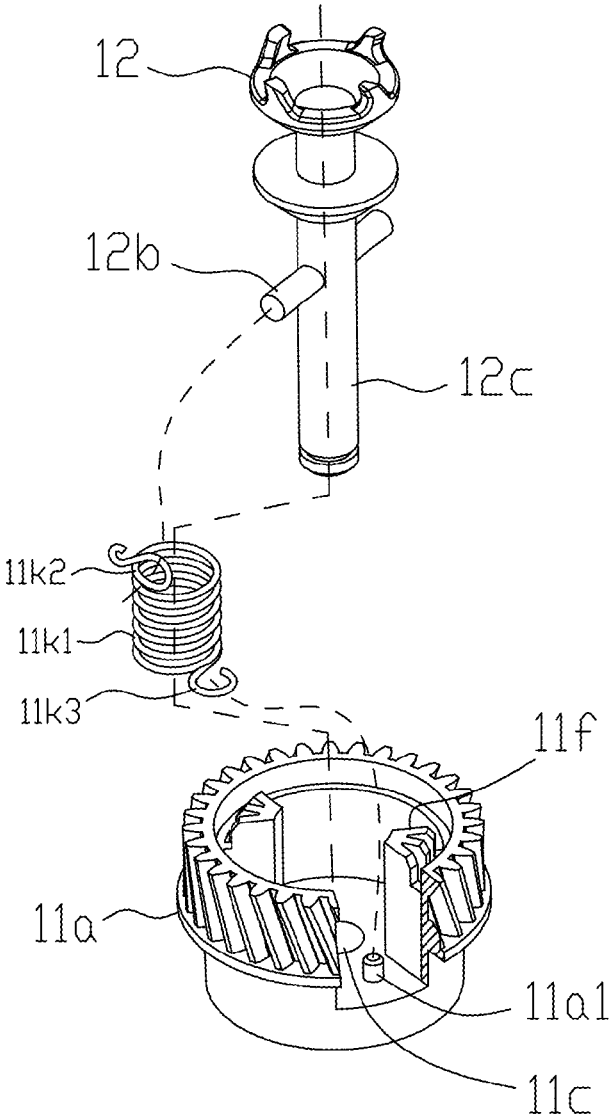
FIG. 41 is a schematic diagram illustrating the assembly of the torsional spring member and the driving force receiving opening and the flange, in the first embodiment of the invention.
Figure 42:
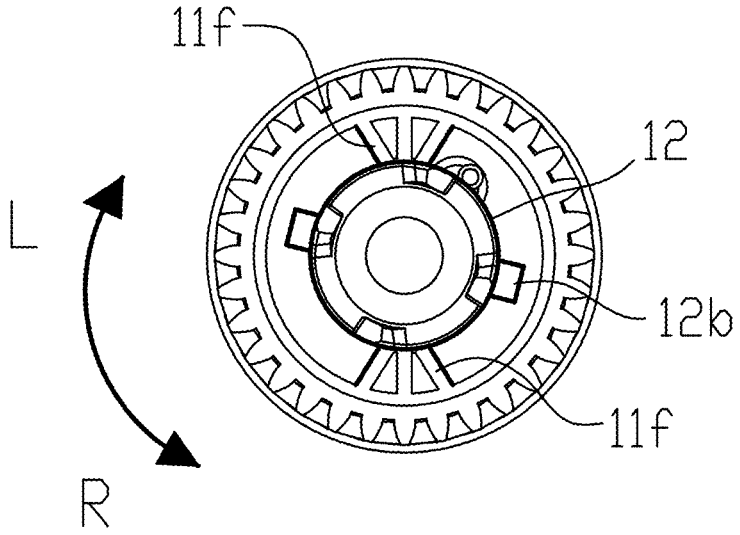
FIG. 42 is a schematic diagram illustrating the action that the driving force receiving opening can partially rotate, in the first embodiment of the invention.

Furthermore, as illustrated in FIG. 40, the steel plate 11*e* in the flange 11*a* may also be replaced by a torsional spring member 11*k*. The torsional spring member 11*k* comprises an elastic part 11*k*1, a first fixing part 11*k*2 and a second fixing part 11*k*3. The first fixing part 11*k*2 is arranged on the top of the elastic part 11*k*1, and the second fixing part 11*k*3 is arranged at the bottom of the elastic part 11*k*1. As illustrated in FIG. 41, the first guide post 12*c* of the driving force receiving opening 12 runs through the elastic part 11*k*1 of the torsional spring member 11*k* and is hence mounted in the first guide groove 11*c*; the first fixing part 11*k*2 of the torsional spring member 11*k* is arranged on the transmission part 12*b* of the driving force receiving opening 12; and the second fixing part 11*k*3 of the torsional spring member 11*k* is arranged on the projection 11*a*1 on the inner bottom surface of the flange 11*a*. Due to the assembly of the torsional spring member 11*k* and the driving force receiving opening 12 and the flange 11*a*, as the transmission part 12*b* is disposed between the stressed columns 11*f* and has a clearance, the driving force receiving opening 12 can partially rotate towards the counterclockwise direction R or the clockwise direction L relative to the rotation axis thereof. After the driving force receiving opening 12 is stressed and start to rotate, as the transmission part 12*b* is arranged on the first fixing part 11*k*2 of the torsional spring member 11*k*, the upper half of the torsional spring member 11*k* is torsional along with the rotation of the driving force receiving opening 12, and the lower half of the torsional spring member 11*k* is fixed as the second fixing part 11*k*3 is arranged on the projection 11*a*1. Thus, when the driving force receiving opening 12 is not stressed, the upper half of the torsional spring member 11*k* in the torsional state releases the elastic torsion to pull the transmission part 12*b*, so that the driving force receiving opening 12 rotates and is restored to the initial state (the position state of the driving force receiving opening 12 before being stressed and rotating), and hence the adjustment function the same with that of the foregoing steel plate 11*e* can be achieved: the transmission part 12*b* is always kept between the two stressed columns 11*f* and does not make contact with the stressed columns 11*f*, and the driving force receiving opening 12 in the flange 11*a* can partially rotate towards the counterclockwise direction R or the clockwise direction L relative to the rotation axis thereof, as illustrated in FIG. 42.

The steel plate 11*e*, the magnetic member 11*g*, the elastic member 11*h* and the torsional spring member 11*k* mounted in the flange 11*a* are all adjusting components for adjusting the position of the transmission part 12*b* of the driving force receiving opening 12 in the flange 11*a*. Before the driving force receiving opening 12 is stressed and rotates, due to the adjusting components thereof, the transmission part 12*b* is always kept between the two stressed columns 11*f* of the flange 11*a* and does not make contact with the stressed columns 11*f*.

What is claimed is:

1. A process cartridge, comprising:

a process cartridge housing;

a flange arranged inside said process cartridge housing;

a driving force receiver connected with said flange and providing a driving force for said flange;

a first guide post arranged on said driving force receiver; and a first guide groove arranged on said flange;

wherein said process cartridge further comprises one or more control mechanism, at least one of said control mechanism controls said driving force receiver to move in the axial direction of said flange;

wherein when viewed from the axial direction of said flange, at least one part of one of said control mechanism is overlapped with said flange, and one part of said control mechanism is outside of the outer periphery of said flange;

wherein said first guide post can slide in the axial direction of said flange on said guide groove.

2. The process cartridge according to claim 1, further comprises a retractable mechanism;

wherein said retractable mechanism comprises an elastic component which is arranged between said driving force receiver and said flange;

said retractable mechanism allows said driving force receiver to move in the axial direction of said flange.

3. The process cartridge according to claim 1, wherein an external force acts on at least one part of said control mechanism to control said driving force receiver to move in the axial direction of said flange.

4. The process cartridge according to claim 1, wherein a second guide post is further arranged on said driving force receiver; a second guide groove is further arranged on the flange; said second guide post can slide, in the axial direction of said flange, on said second guide groove.

5. The process cartridge according to claim 1, wherein a transmission part is further arranged on said driving force receiver; a stressed column is further arranged on the flange; said transmission part can be engaged with said stressed column to transmit the driving force.

6. The process cartridge according to claim 1, wherein said control mechanism further comprises a surface; and a support base is arranged on said driving force receiver; said surface of the control mechanism enables said driving force receiver to move in the axial direction via said support base.

7. The process cartridge according to claim 6, wherein said surface of said control mechanism is an incline surface.

8. The process cartridge according to claim 6, further comprising a guide sleeve, wherein said guide sleeve contacts with said driving force receiver; said driving force receiver can rotate relative to said guide sleeve.

9. The process cartridge according to claim 8, wherein said control mechanism comprises a centering ring, said centering ring can rotate relative to said driving force receiver.

10. The process cartridge according to claim 9, wherein said guide sleeve including a guide sleeve bevel; said centering ring including a centering ring bevel; said guide sleeve bevel contacts with said centering ring bevel to urge said guide sleeve to move in the axial direction when said centering ring rotates relative to the driving force receiver direction when said centering ring rotates relative to the driving force receiver.

11. The process cartridge according to claim 8, further comprises a second flange, wherein said second flange comprises one or more clamping blocks; and said guide sleeve comprises one or more axial limiting interfaces; at least one of said clamping blocks is arranged inside one of the axial limiting interfaces for limiting the rotational movement of the guide sleeve.

12. A control mechanism for a process cartridge, said a process cartridge comprises a process cartridge housing; a flange arranged inside said process cartridge housing; a driving force receiver connected with said flange and providing a driving force for said flange;

a first guide post arranged on said driving force receiver; and a first guide groove arranged on said flange;

wherein said control mechanism controls said driving force receiver to move in the axial direction of said flange;

wherein when viewed from the axial direction of said flange, at least one part of one of said control mechanism is overlapped with said flange, and one part of said control mechanism is outside of the outer periphery of said flange;

wherein said first guide post can slide in the axial direction of said flange on said guide groove.

13. The control mechanism for a process cartridge according to claim 12, wherein said control mechanism is arranged at one side of said process cartridge and being at the same side which said driving force receiver is arranged.

14. The control mechanism for a process cartridge according to claim 13, wherein an external force acts on at least one part of said control mechanism to control said driving force receiver to move in the axial direction of said flange.

15. The control mechanism for a process cartridge according to claim 13, wherein said control mechanism further comprises a surface; and a support base is arranged on said driving force receiver; said surface of the control mechanism enables said driving force receiver to move in the axial direction via said support base.

16. The control mechanism for a process cartridge according to claim 15, further comprises a guide sleeve, wherein said guide sleeve contacts with said driving force receiver; said driving force receiver can rotate relative to said guide sleeve.

17. The control mechanism for a process cartridge according to claim 16, wherein said control mechanism comprises a centering ring, said centering ring can rotate relative to said driving force receiver.

18. The control mechanism for a process cartridge according to claim 17, wherein said guide sleeve including a guide sleeve bevel; said centering ring including a centering ring bevel; said guide sleeve bevel contacts with said centering ring bevel to urge said guide sleeve to move in the axial direction when said centering ring rotates relative to the driving force receiver.

19. The control mechanism for a process cartridge according to claim 16, further comprises a second flange, wherein said second flange comprises one or more clamping blocks; and said guide sleeve comprises one or more axial limiting interfaces; at least one of said clamping blocks is arranged inside the one of said axial limiting interfaces for limiting the rotational movement of the guide sleeve.

20. An image forming device for applying a rotational force for a process cartridge, wherein said image forming device comprises a process cartridge according to claim 1.

* * * * *